US005595863A

United States Patent [19]

Yamanouchi et al.

[11] Patent Number: 5,595,863

[45] Date of Patent: *Jan. 21, 1997

[54] SILVER HALIDE EMULSION PREPARED IN THE PRESENCE OF POLYMERS AND A PHOTOGRAPHIC MATERIAL USING THE SAME

[75] Inventors: Junichi Yamanouchi; Yoichi Hosoya, both of Kanagawa, Japan

[73] Assignee: Fuji Photo Film Co., Ltd., Kanagawa, Japan

[ * ] Notice: The term of this patent shall not extend beyond the expiration date of Pat. No. 5,439,787.

[21] Appl. No.: 537,225

[22] Filed: Sep. 29, 1995

Related U.S. Application Data

[63] Continuation of Ser. No. 312,657, Sep. 27, 1994.

[30] Foreign Application Priority Data

Sep. 28, 1993 [JP] Japan ..... 5-263128

[51] Int. Cl.[6] ..... G03C 1/035; G03C 1/04

[52] U.S. Cl. ..... 430/567; 430/569; 430/602; 430/627; 430/637

[58] Field of Search ..... 430/567, 569, 430/602, 627, 637

[56] References Cited

U.S. PATENT DOCUMENTS

| | | | |
|---|---|---|---|
| 5,147,771 | 9/1992 | Tsaur et al. | 430/569 |
| 5,147,772 | 9/1992 | Tsaur et al. | 430/569 |
| 5,147,773 | 9/1992 | Tsaur et al. | 430/569 |
| 5,171,659 | 12/1992 | Tsaur et al. | 430/569 |
| 5,210,013 | 5/1993 | Tsaur et al. | 430/567 |
| 5,215,879 | 6/1993 | Suzuki et al. | 430/569 |
| 5,272,048 | 12/1993 | Kim et al. | 430/567 |
| 5,439,787 | 8/1995 | Yamanouchi et al. | 430/567 |

FOREIGN PATENT DOCUMENTS

| | | | |
|---|---|---|---|
| 0514742 | 11/1992 | European Pat. Off. . | |
| 2-838 | 1/1990 | Japan . | |
| 0054245 | 2/1990 | Japan | 430/569 |

*Primary Examiner*—Janet C. Baxter

*Attorney, Agent, or Firm*—Sughrue, Mion, Zinn, Macpeak & Seas

[57] ABSTRACT

There are disclosed a hexagonal silver halide tabular emulsion having an excellent monodispersibility and a silver halide photographic material which contains the above tabular silver halide emulsion and excels in a graininess, a sensitivity and a preservability. The above silver halide photographic emulsion is prepared in the presence of at least one of the polymers having a recurring unit represented by the Formula (1) and at least one of the polymers having a recurring unit represented by Formula (2):

$$-(R-O)_n- \quad (1)$$

$$-(CH_2CH_2O)_m- \quad (2)$$

wherein R represents an alkylene group having 3 to 10 carbon atoms; and n and m each represents an average number of the recurring unit, respectively and each represents 4 to 200.

6 Claims, 1 Drawing Sheet

SILVER HALIDE EMULSION PREPARED IN THE PRESENCE OF POLYMERS AND A PHOTOGRAPHIC MATERIAL USING THE SAME

This is a continuation of application Ser. No. 08/312,657, filed on Sep. 27, 1994.

FIELD OF THE INVENTION

The present invention relates to a silver halide emulsion which is formed in the presence of a novel polymer and a silver halide photographic material containing the above silver halide emulsion, more specifically to a hexagonal silver halide tabular emulsion having an excellent monodispersibility and a silver halide photographic material which contains the above tabular silver halide emulsion and excels in a graininess, a sensitivity and a preservability.

BACKGROUND OF THE INVENTION

A silver halide grain containing two or more parallel twin planes has a tabular form (hereinafter referred to as a tabular grain). Said tabular grain includes the following features as a photographic characteristic.

1) A ratio of a surface area to a volume (hereinafter referred to as a specific surface area) is large and a lot of a sensitizing dye can be adsorbed on the surface thereof. That results in providing a relatively high color sensitized sensitivity.

2) Since in the case where an emulsion containing the tabular grain is coated and dried, the grains thereof are aligned parallel to a surface of a support, a light scattering by the grains can be reduced thereby improving in a sharpness and a resolution of images. Further, said alignment can allow a thickness of a coated layer to be thinned and the sharpness of the images can be improved.

3) Since the specific surface area is large, a development rate can be accelerated.

4) Since a covering power of the silver halide emulsion is high, an amount of the silver can be saved.

Thus, the tabular grain has many advantages and therefore, it has so far been used for a commercially available light-sensitive material having a high sensitivity.

The emulsion grains having an aspect ratio of 8 or more are disclosed in JP-A-58-113926 (the term "JP-A" as used herein means an unexamined published Japanese patent application), JP-A-58-113927 and JP-A-58-113928. The aspect ratio referred herein means a ratio of a diameter to a thickness of the tabular grain. Further, the diameter of the grain means a diameter of a circle having the same area as a projected area of the grain. The thickness means a distance between the two paralleled subject surfaces which constitute the tabular grain.

However, as can be seen in the examples of the referenced patents described above, the tabular grains prepared by the conventional processes have an inferior monodipersibility due to the following reasons.

(1) The tabular grains show broad distribution in a projected diameter area, and (2) in addition to the tabular grain, there are mixed a stick-shaped grain, a tetrapod-shaped grain, a singlet twin grain and a grain having a non-parallel twin plane.

These features may cause the defects as follows:

(A) enhanced contrast of image (so-called high gamma) in a characteristics curve can not be expected, (B) in the case where an emulsion in which large grains and small grains are present by mixture is subjected to a chemical sensitization, it is difficult to provide an optimum chemical sensitization to the both since the large grain and the small grain each has a different requirement for the chemical sensitization, and (C) a multi-layer system, wherein monodispersed large grains are present on an upper layer and monodispersed small grains are present on a lower layer, provides higher sensitivity rather than an emulsion-coated layer wherein the large grains and the small grains are present in a mixture in terms of a utilizing efficiency of a light. However, this system has such a defect that this effect can not sufficiently be utilized.

Accordingly, various attempts for a monodispersion of the tabular grain have so far been made and several patents have been disclosed. The monodispersed tabular grains disclosed in JP-A-52-153428 has a restriction that an AgI crystal should be used as a nucleus, and a grain formed has a tabular grain in a small ratio. A grain growth condition for the monodispersing the tabular grain is disclosed in JP-A-55-142329 but the grains formed have a low ratio of the tabular grain. The monodispersed twin grains disclosed in JP-A-51-39027 are prepared by a process which comprises forming a nucleus, adding a silver halide solvent for ripening, followed by growing thereof, however, the grains obtained show a low ratio of the tabular grain which has a low aspect ratio as well. The monodispersed twin grains are also included in JP-A-61-112142 for a grain-forming process, in which a spherical grain is used as a seed crystal, however, an aspect ratio of the tabular grain is 2.2 or less and only a tabular grain emulsion having a low tabular grain ratio was obtained. The monodispersed tabular grains described in French Patent 2534036 are formed by a process comprising forming a nucleus, and ripening without using a silver halide solvent to obtain the grains having a fluctuation coefficient (a value which is obtained by multiplying a value obtained by dividing a standard deviation of a circle-corresponding diameter with an average circle-corresponding diameter by 100) of 15% in the circle-corresponding diameter of the tabular grains.

According to a calculation from a grain shown in photo which is attached to the examples of French patent, a projected area of a triangle tabular grain shares 50% or more is demonstrated. According to J. E. Maskasky, J. Imaging Sci., 31, 1987, pp. 15 to 26, said triangle tabular grain is a grain having three twin planes which are parallel to a main surface.

The monodispersed tabular grains containing the hexagonal tabular grains are disclosed in JP-A-63-11928, JP-A-63-151618 and JP-A-2-838. The hexagonal tabular grain is a grain having two parallel twin planes unlike the triangle tabular grain described above. In Example 1 of JP-A-2-838 described above, the monodispersed tabular grains in which the tabular grains having two parallel twin planes share a ratio of 99.7% in the whole projected area and a fluctuation coefficient in a circle-corresponding diameter is 10.1%.

The processes in which the monodispersed tabular grains are obtained by allowing a polyalkylene oxide block copolymer to coexist in forming a nucleus are disclosed in U.S. Pat. Nos. 5,147,771, 5,171,659, 5,147,772, and 5,147,773. Further, a monodispersed tabular grain emulsion having a fluctuation coefficient of 10% or less is disclosed in European Patent 514742A, wherein the polyalkylene oxide block copolymer described above is used in all of the examples.

However, while forming the tabular grains according to this example leads to formation of the monodispersed tabular grains, the hexagonal tabular grains are of a distorted form in which each length of the six sides is different one another at random. In general, it is known that among the arrangements of the respective pixel in an image sensor, an ideal pixel arrangement is a honeycomb structure, and preferably, an equilateral hexagonal form (J. C. Dainty and R. Shaw, Image Science, Academic Press, London, 1974). Accordingly, the formation of the hexagonal tabular grains having a more uniform shape has been desired. While it has been observed that application of the monodispersed tabular grains thus obtained to a silver halide photographic material leads improvement in a graininess and a sensitivity, it includes the problems that the improvement is not sufficient and further that this tabular emulsion does not necessarily have a sufficient preservability (a latent image preservability) lasting to a development of a photographic material after photographing, and further improvement has been desired,

SUMMARY OF THE INVENTION

Figure 1:
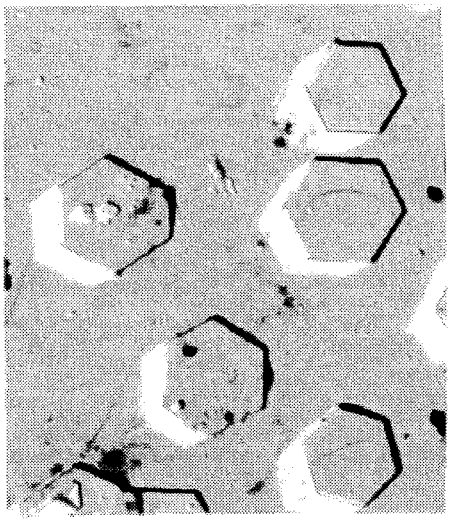
FIG. 1 and FIG. 2 show the replica transmission electron microscopic photos of the crystal structures of the grains prepared in Example 1 and Comparative Example 1 of the present invention, respectively.
Figure 2:
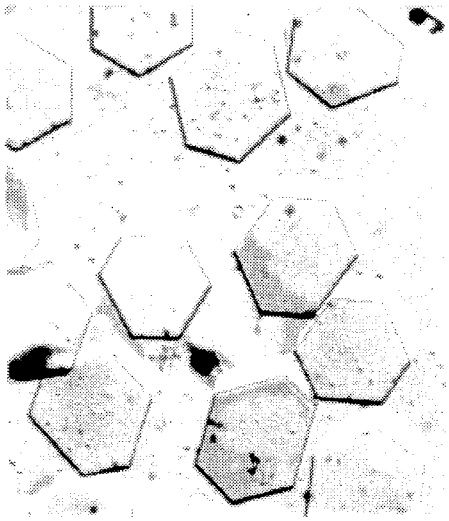

A first object of the present invention is to provide a silver halide tabular grain emulsion which has an even hexagonal form and an excellent monodispersibility.

A second object of the present invention is to provide a silver halide photographic material which provides an excellent graininess, sensitivity and preservability by using the above silver halide tabular grain emulsion.

The above objects of the present invention have been achieved by the following findings:

A silver halide photographic emulsion which is prepared in the presence of at least one polymers having a recurring unit represented by Formula (1) and at least one polymers having a recurring unit represented by Formula (2):

$$-(R-O)_n- \quad (1)$$

$$-(CH_2CH_2O)_m- \quad (2)$$

wherein R represents an alkylene group having 3 to 10 carbon atoms; and n and m each represents an average number of the recurring unit, respectively, and each represents 4 to 200.

The silver halide photographic emulsion described above, wherein the polymer having the recurring unit represented by Formula (1) is at least one polymer selected from a vinyl polymer having a monomer represented by the Formula (3) as a constitutional component and a polyurethane represented by Formula (4); and the polymer having the recurring unit represented by Formula (2) is at least one polymer selected from a vinyl polymer having a monomer represented by Formula (5) as a constitutional component, a polyurethane represented by the Formula (6) and substituted or non-substituted polyethylene glycol:

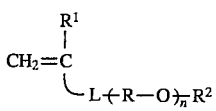

(3)

-continued

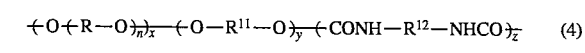

(4)

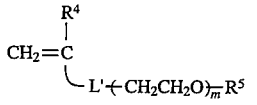

(5)

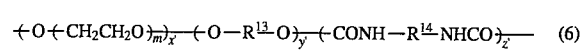

(6)

wherein R, n and m are synonymous with those defined above; $R^1$ and $R^4$ each represents a hydrogen atom or a lower alkyl group having 1 to 4 carbon atoms; $R^2$ and $R^5$ each represents a hydrogen atom or a monovalent substituent having 1 to 20 carbon atoms; L and L' each represents a divalent linkage group; $R^{11}$ and $R^{12}$ each represents an alkylene group having 1 to 20 carbon atoms, a phenylene group having 6 to 20 carbon atoms or an aralkylene group having 7 to 20 carbon atoms; x, y, z, x', y', and z' represent weight percentages of the respective components; x and x' each represents 1 to 70; y and y' each represents 1 to 70; and z and z' each represents 20 to 70, in which x+y+z=100 and x'+y'+z'=100.

The silver halide photographic emulsion described above, wherein the emulsion contains a tabular grain having an aspect ratio of 2 to 100.

The silver halide photographic emulsion described above, wherein the tabular grain has a fluctuation coefficient of 20% or less in a circle-corresponding diameter.

A silver halide photographic material comprising a support and provided thereon at least one light-sensitive silver halide emulsion layer, wherein the above silver halide emulsion layer contains the silver halide emulsion described above.

DETAILED DESCRIPTION OF THE INVENTION

In the present invention, the silver halide emulsion obtained comprises a dispersing medium and the silver halide grains and is characterized by that 95% or more of the whole projected area of the above silver halide grains is shared by the tabular grains each having two twinned planes which are parallel to a primary plane and the above tabular grain has a hexagonal form and that the above tabular grain has a size distribution of a monodispersion.

The hexagonal tabular grain according to the present invention is a tabular grain in which a ratio of the lengths of the adjacent two sides among the six sides constituting a hexagon is 2 or less and a deviation of a ratio in the lengths of any adjacent two sides among the six sides from a ratio of the other two sides is 10% or less.

The monodispersed hexagonal tabular grain of the present invention is characterized by that it is monodispersed.

The monodispersibility used herein is defined by a fluctuation coefficient. The monodispersibility of the tabular grain of the present invention is preferably 20% or less, particularly preferably 15% or less in terms of the fluctuation coefficient.

The monodispersed hexagonal tabular grain of the present invention has an average aspect ratio of 2 or more, wherein the average aspect ratio means an average value of the aspect ratios of the whole tabular grains which are present in an emulsion and have a diameter of 0.2 μm or more.

The polymers which are used for forming the silver halide emulsion of the present invention will be explained below in detail.

The polymers used are at least one polymers having the recurring unit represented by Formula (1) described previously and at least one polymers having the recurring unit represented by Formula (2) described previously:

$$-(R-O)_n- \quad (1)$$

$$-(CH_2CH_2O)_m- \quad (2)$$

wherein R represents an alkylene group having 3 to 10 carbon atoms, and to be concrete, there can be enumerated $-CH(CH_3)CH_2-$, $-CH_2CH(CH_3)-$, $-CH_2CH_2CH_2-$, $-CH_2CH(OH)CH_2-$, $-(CH_2)_4-$, $-(CH_2)_5-$, and $-CH_2CH(C_6H_5)-$. Of them, $-CH(CH_3)CH_2-$ and $-CH_2CH(CH_3)-$ are particularly preferred.

Suffixus n and m represent the average numbers of the recurring units. Suffix n is 4 to 200, preferably 4 to 80, and particularly preferably 6 to 40, and suffix m is 4 to 200, preferably 4 to 100, and particularly preferably 6 to 50.

Either only one recurring unit represented by R—O may be used in the polymer of the present invention or two or more may be present therein. Further, two or more polymers each having a different average number (molecular weight) of the recurring unit represented by R—O or $CH_2CH_2O$ may be used, respectively.

The polymer containing the recurring unit represented by Formula (1) will be explained in more detailed. The polymer containing the above recurring unit includes various types. In forming the emulsion of the present invention, the polymer can preferably be used if the recurring unit of Formula (1) is contained therein. A vinyl polymer of a monomer represented by the Formula (3) or polyurethane containing the recurring unit represented by Formula (1) described above is preferably used and the vinyl polymer having the recurring unit represented by Formula (3) described above is particularly preferred:

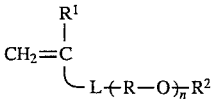

(3)

wherein $R^1$ represents a hydrogen atom or a lower alkyl group; $R^2$ represents a monovalent substituent; L represents a divalent linkage group; and R and n are synonymous with those defined previously.

To explain in further details, $R^1$ represents a hydrogen atom or a lower alkyl group having 1 to 4 carbon atoms (for example, methyl, ethyl, n-propyl, and n-butyl), and a hydrogen atom and methyl are particularly preferred.

$R^2$ represents a monovalent substituent having 1 to 20 carbon atoms, and to be concrete, preferred are a hydrogen atom, a substituted or unsubstituted alkyl group having 1 to 20 carbon atoms (for example, methyl, ethyl, isopropyl, n-hexyl, n-dodecyl, benzyl, 2-cyanoethyl, 2-chloroethyl, 3-methoxypropyl, 4-phenoxybutyl, 2-carboxyethyl, $-CH_2CH_2SO_3Na$, and $-CH_2CH_2NHSO_2CH_3$), a substituted or unsubstituted aryl group (for example, phenyl, p-methylphenyl, p-methoxyphenyl, o-chlorophenyl, p-octylphenyl, and naphthyl), an acyl group (for example, acetyl, propionyl, benzoyl, and octanoyl), and a carbamoyl group (for example, $-CONHCH_3$, $-CON(CH_3)_2-$, and $-CONHC_6H_{13}$). In particular, a hydrogen atom, methyl, ethyl, phenyl, and acetyl are preferred.

L represents a divalent linkage group and preferably represents a group represented by Formula (7) or Formula (8):

$$-CO-X_1-L_1-X_2- \quad (7)$$

In the formula, $X_1$ represents an oxygen atom or $-NR^6-$ (wherein $R^6$ is a hydrogen atom, a substituted or unsubstituted alkyl group, a substituted or unsubstituted aryl group, a substituted or unsubstituted acyl group, or a group represented by $-L_1-X_2-(R-O)_n-R^2$, and preferably a hydrogen atom, a substituted or unsubstituted alkyl group having 1 to 10 carbon atoms (for example, methyl, ethyl, n-butyl, and n-octyl), $L_1-X_2-(R-O)_n-R^2$, or an acyl group (for example, acetyl and benzoyl).

An oxygen atom or —NH— is particularly preferred as $X_1$. $L_1$ represents a single bond, a substituted or unsubstituted alkylene group (for example, dimethylene, trimethylene, tetramethylene, decamethylene, methyldimethylene, phenyldimethylene, $-CH_2(C_6H_4)CH_2-$, and $-CH_2CH_2NHCOOCH_2-$), or a substituted or unsubstituted arylene group (for example, o-phenylene, m-phenylene, p-phenylene, and methylphenylene), and a single bond and $-(CH_2)_l-$ (wherein l is an integer of 3 to 12) are particularly preferred.

$X_2$ represents a single bond, an oxygen atom, —COO—, —OCO—, $-CONR^6-$, $-NR^6CO-$, —OCOO—, $-NR^6COO-$, $-OCONR^6-$, or $-NR^6-$ (wherein $R^6$ is synonymous with that defined previously). Of them, a single bond, an oxygen atom, —COO—, —CONH—, —NHCOO—, and —NHCONH— are particularly preferred.

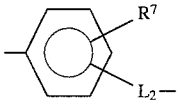

(8)

In the formula, $R^7$ represents a hydrogen atom, a substituted or unsubstituted alkyl group or an acyl group and is preferably a hydrogen atom, a chlorine atom, a lower alkyl group having 1 to 6 carbon atoms, or a lower acyl group. In particular, a hydrogen atom and methyl are preferred. $L_2$ represents a single bond, $-L_1-$, $-X_2-$, $-L_1-X_2-$, $-X_1-L_1-X_2-$, or $-CO-X_1-L_1-X_2-$ (wherein $X_1$, $X_2$ and $L_1$ are synonymous with those defined above). $-L_1-$, $-X_2-$ and $-L_1-X-$ are preferred, and $-CH_2)-$, —COO—, —CONH—, and —O— are particularly preferred.

Either only one recurring unit represented by R—O may be contained in one monomer or two or more kinds thereof may be contained to form a copolymer.

n represents an average mole number of the recurring unit. It is 4 to 200, preferably 4 to 50, and particularly preferably 6 to 40.

A preferred example of the monomer represented by Formula (3) will be shown below but the present invention will not be limited thereto.

MP-1~5

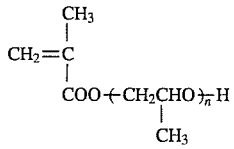

MP-1 n = 6
MP-2 n = 9
MP-3 n = 12
MP-4 n = 20
MP-5 n = 40

MP-6~8

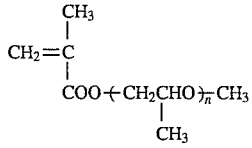

MP-6 n = 4
MP-7 n = 12
MP-8 n = 30

-continued

MP-9

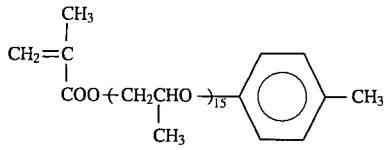

MP-10, 11

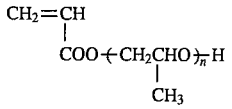

MP-10 n = 6
MP-11 n = 18

MP-12

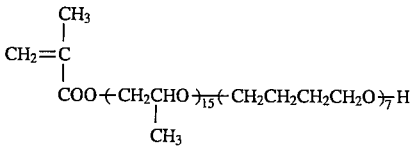

MP-13

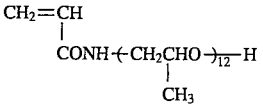

MP-14, 15

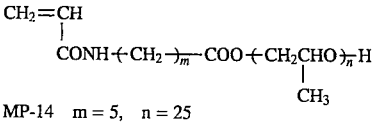

MP-14 m = 5, n = 25
MP-15 m = 3, n = 12

MP-16, 17

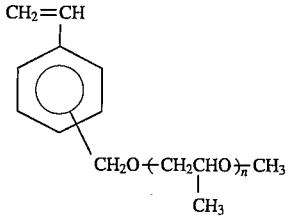

MP-16 n = 8
MP-17 n = 20

MP-18

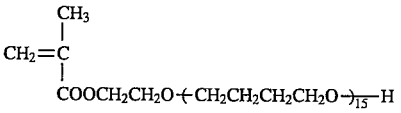

In case of the vinyl polymer, it is preferably a copolymer with a monomer other than the monomer represented by Formula (3) described above.

Such a copolymerizable monomer includes, for example, acrylic esters, methacrylic esters, acrylamides, methacrylamides, vinyl esters, vinyl ketones, an allyl compound, olefins, vinyl ethers, N-vinylamides, a vinyl heterocyclic compound, maleic esters, itaconic esters, fumaric esters, and crotonic esters. Further, to concretely list, the following ones are included:

Hydrophobic monomers, the homopolymers of which are insoluble in water, such as methyl acrylate, ethyl acrylate, n-propyl acrylate, n-butyl acrylate, sec-butyl acrylate, octyl acrylate, diethylene glycol monoacrylate, trimethyloethane monoacrylate, 1-bromo-2-methoxyethyl acrylate, p-chlorophenyl acrylaye, methyl methacrylate, ethyl methacrylate, N-tertbutylacrylamide, hexylacrylamide, octylacrylamide, ethyl vinyl ether, propyl vinyl ether, butyl vinyl ether, 2-ethylbutyl vinyl ether, vinyl acetate, vinyl propionate, ethylene, propylene, 1-butene, 1-octene, dioctyl itaconate, dihexyl maleate, styrene, methylstyrene, dimethylstyrene, benzylstyrene, chloromethylstyrene, chlorostyrene, methyl vinylbenzoate, vinyl chlorobenzoate, acrylonitrile, methacrylonitrile, and vinyl chloride; acrylamide, N-methylacrylamide, N-ethylacrylamide, N-n-propylacrylamide, N-isopropylacrylamide, N,N-dimethylacrylamide, N-acryloymorpholine, N-acryloylpiperidine, methacrylamide, N-methylmethacrylamide, N-methacryloylmorpholine, N-vinylpyrrolidone, and N-vinylacetamide; a —COOH-containing monomer such as acrylic acid, methacrylic acid, itaconic acid, and maleic anhydride; and a monomer the homopolymer of which is water soluble including a monomer having the other anionic dissociative group, such as 2-acrylamide-2-methylpropanesulfonic acid (and the salt thereof), sodium p-styrenesulfonate, and phosphoxyethyl methacrylate.

Two or more kinds of the monomer represented by Formula (3) described above and the other ethylenically unsaturated monomers may be used.

The polymer having the recurring unit of the present invention represented by Formula (1) is desirably soluble in a medium constituting the tabular grain and accordingly, it is preferably soluble in an aqueous medium.

That is, it satisfies preferably a solubility either in water or a mixed solvent of water and an organic solvent which is miscible with water.

A standard for a water solubility of the polymer in the present invention is that the polymer is dissolved by 1 weight % or more in either of distilled water or a mixed solvent (a weight ratio of 9:1) of distilled water and methanol.

A ratio at which the monomer unit represented by Formula (3) shares in the vinyl polymer of the present invention is 1 to 90 weight %, preferably 3 to 85 weight %, and particularly preferably 5 to 70 weight %.

With respect to the kind of the other ethylenically unsaturated monomer, a monomer, the homopolymer of which is water soluble, is preferably used taking a solubility of the polymer in an aqueous medium into consideration. Provided that it goes without saying that a monomer the homopolymer of which is water insoluble can be used as well in a range that a solubility of the polymer is not damaged.

A molecular weight of the polymer can diversely be changed according to a polarity of the polymer and a kind of a monomer used. A preferred range is $2\times10^3$ to $1\times10^6$, particularly preferably $3\times10^3$ to $5\times10^5$ in terms of a weight-average molecular weight.

Polyurethane will be explained below.

The preferred polyurethane according to the present invention is represented by Formula (4):

$$\text{-}(O\text{-}R\text{-}O)_x\text{-}(O\text{-}R^{11}\text{-}O)_y\text{-}(CONH\text{-}R^{12}\text{-}NHCO)_z\text{-} \quad (4)$$

In the formula, R is synonymous with that defined in Formula (3) described previously.

$R^{11}$ represents a divalent linkage group and preferably represents an alkylene group having 1 to 20 carbon atoms (including a substituted alkylene group), an aralkylene group having 7 to 20 carbon atoms (including a substituted aralkylene group), or a phenylene group having 6 to 20 carbon atoms (including a substituted phenylene group).

The substituents for an alkylene group, an aralkylene group and a phenylene group represented by $R^{11}$ are not specifically limited. Example of the substituent includes preferably a halogen atom (a fluorine atom, a chlorine atom and a bromine atom), a cyano group, an alkoxy group (for example, methoxy, ethoxy and benzyloxy), an aryloxy group (for example, phenoxy), a nitro group, an amino group, a carboxyl group, an alkyloxycarbonyl group (for example, methoxycarbonyl and propoxycarbonyl), an acyl group (for example, acetyl and benzoyl), an alkylcarbamoyl group (for example, dimethylcarbamoyl), an acylamino group (for example, acetylamino), and a sulfonyl group.

$R^{12}$ represents a divalent linkage group and represents preferably an alkylene group having 1 to 20 carbon atoms (including a substituted alkylene group), an aralkylene group having 7 to 20 carbon atoms (including a substituted aralkylene group), or a phenylene group having 6 to 20 carbon atoms (including a substituted phenylene group).

The substituents for a alkylene group and an aralkylene group represented by $R^{12}$ are not specifically limited. Example of the substituent includes preferably a halogen atom (a fluorine atom, a chlorine atom and a bromine atom), a cyano group, an alkoxy group (for example, methoxy, ethoxy and benzyloxy), an aryloxy group (for example, phenoxy), a nitro group, an alkyloxycarbonyl group (for example, methoxycarbonyl and propoxycarbonyl), an acyl group (for example, acetyl and benzoyl), an alkylcarbamoyl group (for example, dimethylcarbamoyl), an acylamino group (for example, acetylamino), and a sulfonyl group.

Suffix n represents an average number of the recurring unit, which is 4 to 200, preferably 4 to 80, and particularly preferably 6 to 40.

Suffix n, smaller than 4, decreases a monodispersibility of an emulsion obtained and too large n makes it difficult to efficiently introduce an oxyalkylene residue into polyurethane since a number of diol which reacts with isocyanate is decreased.

Polyurethane of the present invention is synthesized basically by an addition of a diol compound and a diisocyanate compound.

First of all, diol represented by Formula (9) described below is used as the diol compound:

$$HO\text{-}(R-O)_n\text{-}H \quad (9)$$

In the formula, R and n are synonymous with thosed described previously and the following compounds can be listed as an example of diol represented by Formula (9) (wherein n represents a number of a recurring unit as described above).

MP-19

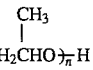

$$HO\text{-}(CH_2CHO)_n\text{-}H$$

MP-20

$$HO\text{-}(CH_2CH_2CH_2O)_n\text{-}H$$

MP-21

$$HO\text{-}(CH_2CH_2CH_2CH_2O)_n\text{-}H$$

MP-22

$$HO\text{-}(CH_2CH_2CH_2CH_2CH_2CH_2O)_n\text{-}H$$

MP-23

-continued

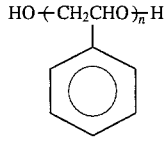

MP-24

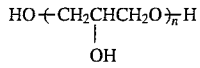

MP-25

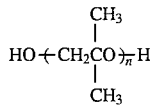

MP-26

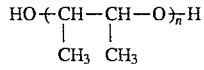

Diol may be the copolymer thereof (for example, a copolymer of MP-19 and MP-21).

In the polyurethane according to the present invention, the other diols represented by Formula (10) shown below are used as well in addition to those represented by Formula (7) described above:

$$HO-R^{11}-OH \quad (10)$$

(wherein $R^{11}$ is synonymous with that described previously).

As a concrete example of such an organic diol includes ethylene glycol, 1,2-propanediol, 1,3-propanediol, 1,2-butanediol, 1,3-butanediol, 1,4-butanediol, 2,3-butanediol, 2,2-dimethyl-1,3-propanediol, 1,2-pentanediol, 1,4-pentanediol, 1,5-pentanediol, 2,4-pentanediol, 3,3-dimethyl-1,2-butanediol, 2-ethyl-2-methyl-1,3-propanediol, 1,2-hexanediol, 1,5-hexanediol, 1,6-hexanediol, 2,5-hexanediol, 2-methyl-2,4-pentanediol, 2,2-diethyl-1,3-propanediol, 2,4-dimethyl-2,4-pentanediol, 1,7-heptanediol, 2-methyl-2-propyl-1,3-propanediol, 2,5-dimethyl-2,5-hexanediol, 2-ethyl-1,3-hexanediol, 1,2-octanediol, 1,8-octanediol, 2,2,4-trimethyl-1,3-pentanediol, 1,4-cyclohexanedimethanol, hydroquinone, diethylene glycol, triethylene glycol, dipropylene glycol, and tripropylene glycol.

Since the polyurethane according to the present invention is used for preparing an emulsion in an aqueous medium, a dissociation group is preferably introduced into the polymer to increase a solubility of the polymer in the aqueous medium. There can be listed as a suitable dissociation group, an anionic group such as a carboxyl group, a sulfonic acid group, a sulfuric monoester group, $-OPO(OH)_2$, a sulfinic acid group, or the salts thereof (for example, a salt of alkali metal such as Na and K, or an ammonium salt such as trimethylamine), or a cationic group such as a quaternary ammonium salt. The anionic group is preferred and in particular, the carboxyl group or the salt thereof is preferred.

Diol having a carboxyl group includes 2,2-bis(hydroxymethyl)propionic acid, 2,2bis(hydroxymethyl)butanoic acid, 2,5,6-trimethoxy-3,4-dihydroxyhexanoic acid, and 2,3-dihydroxy-4,5-dimethoxypentanoic acid but will not particularly be limited thereto.

Diisocyanate which constitutes the polyurethane compound of the present invention is represented by Formula (11) shown below:

$$O=C=N-R^{12}-N=C=O \quad (11)$$

(wherein $R^{12}$ is synonymous with that described previously)

There can be listed as a concrete example of such diisocyanate, methylenediisocyanate, ethylenediisocyanate, isophoronediisocyanate, hexamethylenediisocyanate, 1,4-cyclohexyldiisocyanate, 2,4-toluenediisocyanate, 2,6-toluenediisocyanate, 1,3-xylylenediisocyanate, 1,4-xylylenediisocyanate, 1,5-naphthalenediisocyanate, m-phenylenediisocyanate, p-phenylenediisocyanate, 3,3'-dimethyl-4,4'-diphenylmethanediisocyanate, 3,3'-dimethylbiphenylenediisocyanate,4,4'-biphenylenediisocyanate, dicyclohexylmethanediisocyanate, and methylenebis(4-cyclohexylisocyanate).

There may be used either only one kind or two or more kinds of the diol of the present invention represented by Formula (9) or (10) and the diisocyanate represented by Formula (11).

The polyurethane of the present invention is preferably soluble as well in a medium which constitutes a silver halide emulsion grains like the vinyl polymer. Accordingly, it is preferably soluble in an aqueous medium and properties therefor is the same as that described previously.

In the polyurethane of the present invention represented by Formula (4), x, y and z each represents a weight percentages of the respective components; x is 1 to 70, preferably 3 to 50 and particularly preferably 5 to 40 weight %; y depends on x and is 1 to 70, preferably 2 to 60 and particularly preferably 3 to 50 weight %; Z is 20 to 70, preferably 25 to 65, and particularly preferably 30 to 60 weight %.

Further, taking a solubility of the polymer in the aqueous medium into consideration, among the diols represented by Formula (10), the diols having an anionic group (particularly a carboxyl group) are preferably copolymerized in the polymer by not much more than 1 to 30 weight %, particularly preferably 2 to 25 weight %.

A molecular weight of the polyurethane can diversely be changed according to a polarity of the polymer and a kind of a monomer used A preferred range is $2\times10^3$ to $5\times10^5$, particularly preferably $3\times10^3$ to $2\times10^5$.

The concrete examples of the polymers containing the recurring unit of the present invention represented by Formula (1) will be enumerated below in order of the vinyl polymer and the polyurethane but the present invention will not be limited thereto.

in case of the vinyl polymer (PP-1 to 13), the weight percentages in the respective monomers contained in the polymer are shown in a parenthesis and in case of the polyurethane (PP-14 to 18), first, the weight percentages in the respective monomers are shown and next, a mole percentages are shown.

Incidentally, PPG in the exemplified compounds represents polypropylene oxide.

PP-1 MP-3/acrylamide copolymer (10/90)
PP-2 MP-3/acrylamide copolymer (25/75)
PP-3 MP-3/acrylamide copolymer (50/50)
PP-4 MP-3/acrylic acid/acrylamide copolymer (50/30/20)
PP-5 MP-3/acrylic acid copolymer (70/30)
PP-6 MP-2/methacrylamide copolymer (30/70)
PP-7 MP-4/acrylamide copolymer (20/80)
PP-8 MP-7/acrylamide copolymer (30/70)
PP-9 MP-5/acrylamide/methacrylic acid copolymer (25/50/25)
PP-10 MP-12/N,N-dimethylacrylamide/acrylic acid copolymer (30/35/35)
PP-11 MP-7/diacetoneacrylamide copolymer (30/70)
PP-12 MP-13/acrylamide/sodium 2-acrylamide-2-methylpropanesulfonate copolymer (30/60/10)
PP-13 MP-3/MP-18/acrylamide/acrylic acid copolymer (20/20/40/20)
PP-14 isophoronediisocyanate/sodium 2,2-bis(hydroxymethyl)propionate/PPG (Mw=400)/PPG (Mw=1000) (43.1/21.5/15.7/19.7; 50/35/10/5)
PP-15 toluenediisocyanate/sodium 2,2-bis(hydroxymethyl)butanoate/PPG (Mw=1000) (29.3/20.1/50.6; 50/35/15)
PP-16 1,5-naphthylenediisocyanate/sodium 2,2-bis(hydroxymethyl)propionate/PPG (Mw=400) (47.2/24.8/18.0; 50/40/10)
PP-17 4,4'-diphenylmethanediisocyanate/hexamethylenediisocyanate/sodium 2,2-bis(hydroxymethyl)propionate/PPG (Mw=700) (40.1/6.7/25.0/28.1; 40/10/40/10)
PP-18 1,5-naphthylenediisocyanate/hexamethylenediisocyanate/sodium 2,2-bis(hydroxymethyl)butanoate/PPG (Mw=400)/polybutylene oxide (Mw=500) (36.2/12.4/29.3/9.8/12.3; 35/15/40/5/5)

The polymer having the polyethylene oxide recurring unit represented by Formula (2) will be explained.

The polymer having the above recurring unit includes various types, and those having the polyethylene oxide recurring unit could reveal a similar effect. There can be enumerated as the preferred polymer, a homopolymer or a copolymer of the monomer represented by Formula (5) shown below, polyethylene glycol, substituted polyethylene glycol, and polyurethane. Of them, the polymer of the monomer represented by Formula (5) is particularly preferred.

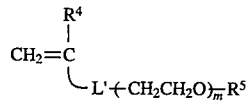

(5)

wherein $R^4$ represents a hydrogen atom or a lower alkyl group; $R^5$ represents a monovalent substituent; L represents a divalent substituent; and m represents a numeral of 4 to 200 as described above.

To further explain the vinyl polymer of the monomer represented by Formula (5), $R^4$ and $R^5$ each represents the groups selected from the same groups as those described in $R^1$ and $R^2$.

L' represents a group selected from the same group as that described in L of Formula (3), except that $—L_1—X_2—(R—O)_m—R^2$ which is a concrete example of $R^6$ described in L of Formula (3) is replaced with $—L_1—X_2—(CH_2CH_2O)_m—R^2$.

Suffix m represents an average mole number of the recurring unit and is 4 to 200, preferably 4 to 100, and particularly preferably 6 to 50.

The preferred examples of the monomer represented by Formula (5) will be shown below but the present invention will not be limited thereto.

ME-1~5

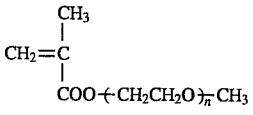

ME-1 n = 4
ME-2 n = 9
ME-3 n = 15
ME-4 n = 23
ME-5 n = 50

ME-6, 7

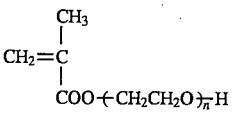

ME-6 n = 6
ME-7 n = 20

-continued

ME-8, 9

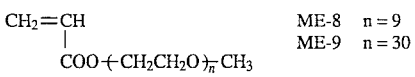

ME-8 n = 9
ME-9 n = 30

ME-10

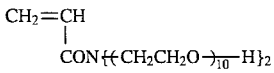

ME-11

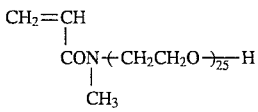

ME-12~14

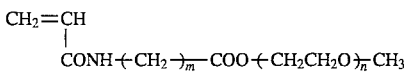

ME-12 m = 1, n = 20
ME-13 m = 3, n = 15
ME-14 m = 10, n = 30

ME-15, 16

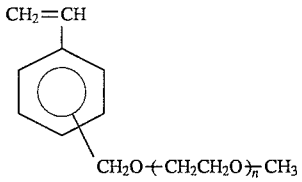

ME-15 n = 8
ME-16 n = 15

The monomer of Formula (5) may be copolymerized with the other ethylenically unsaturated monomers similarly to those described previously, and those exemplified as the monomers which are copolymerizable with the monomer of Formula (3) described previously can be enumerated as the copolymerizable monomer.

Each two or more kinds of the monomer of Formula (5) and the copolymerizable monomer may be used. A solubility and a preferred range of a molecular weight of the polymer obtained are the same as those of the polymer using the monomer of Formula (3) described previously.

A ratio of the monomer unit represented by Formula (5) sharing in the copolymer is 1 to 100 weight %, preferably 5 to 90 weight %, and particularly preferably 10 to 80 weight %.

There can be enumerated as the polymer having the polyethylene oxide recurring unit represented by Formula (2), polyethylene glycol, substituted polyethylene glycol having a substituent with 1 to 30 carbon atoms (each having preferably 4 to 100 ethylene oxide recurring units), and polyurethane. The polyurethane containing the polyethylene oxide recurring unit is polyurethane which is constituted from the same raw materials as those described previously such as the diol of Formula (10) and the diisocyanate of Formula (11), except that in the polyurethane represented by Formula (4), polyethylene glycol is used in place of the diols exemplified as MP-19 to 26.

A ratio of the polyethylene oxide component sharing in the polyurethane is 1 to 70 weight %, preferably 3 to 50 weight %, and particularly preferably 5 to 40 weight %. A preferred copolymerization amount and a preferred molecular weight of the diol having an anionic group fall in the same ranges as those of the polyurethane of Formula (4) described previously.

A solubility of the polymer containing the recurring unit represented by Formula (2), which has so far been described, is preferably soluble in an aqueous medium similarly to those described previously, and the properties thereof is such that it is dissolved in either of distilled water or a mixed solvent (a weight ratio of 9: 1) of distilled water and methanol by 1 weight % or more.

The concrete examples of the polymer containing the recurring unit represented by Formula (2) will be listed below but the present invention will not be limited thereto.

In case of the vinyl polymer, the weight percentages in the respective monomers contained in the polymer are shown in a parenthesis and in case of the polyurethane, first, the weight percentages in the respective monomers are shown and next, the mole percentages are shown.

PE-1 ME-4/acrylamide copolymer (10/90)
PE-2 ME-4/acrylamide copolymer (25/75)
PE-3 ME-4/acrylamide copolymer (50/50)
PE-4 ME-4/acrylamide/acrylic acid copolymer (50/25/25)
PE-5 ME-4 homopolymer
PE-6 ME-2/acrylamide copolymer (30/70)
PE-7 ME-1/MP-4/methacrylamide copolymer (15/15//70)
PE-8 ME-7/acrylamide/methacrlic acid copolymer (35/60/5)
PE-9 ME-13/N,N-dimethylacrylamide/sodium 2-acrylamide-2-methylpropanesulfonate copolymer (40/45/15)
PE-10 ME-16/sodium styrenesulfonate copolymer (50/50)
PE-11 ME-10/acrylamide/sodium 2-acrylamide-2-methylpropanesulfonate copolymer (25/65/10)
PE-12 ME-3/2-hydroxyethyl methacrylate/methacrylic acid copolymer (30/30/40)
PE-13 ME-9/methyl acrylate/acrylamide/acrylic acid copolymer (25/15/50/10 )
PE-14 polyethylene glycol (molecular weight: 200 to 5000)

PE-15

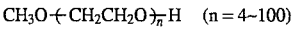

PE-16

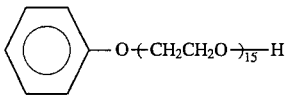

PE-17

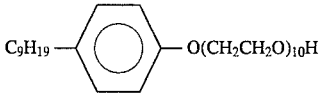

PE-18

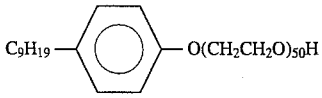

PE-19

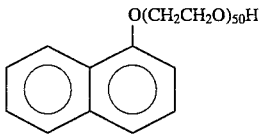

PE-20

-continued

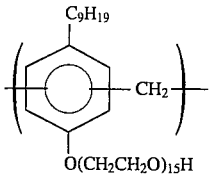

PE-21

$C_{12}H_{25}O(CH_2CH_2O)_{10}H$

PE-22

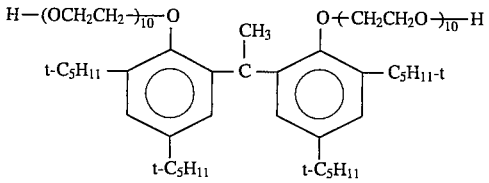

PE-23

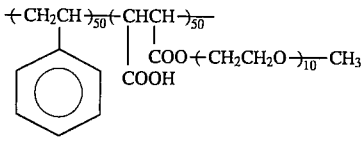

PE-24 toluenediisocyanate/sodium 2,2-bis(hydroxymethyl)butanoate/polyethylene glycol (Mw=1000) (29.3/20.1/50.6; 50/35/15)

PE-25 4,4'-diphenylmethanediisocyanate/sodium 2,2-bis(hydroxymethyl)propionate/polyethylene glycol (Mw=400) (45.3/11.3/43.4; 50/20/30)

PE-26 4,4'-diphenylmethanediisocyanate/hexamethylenediisocyanate/ethylene glycol/potassium 2,2-bis(hydroxymethyl)propionate/polyethylene glycol (Mw=1000) (39.1/6.6/2.4/16.8/35.1; 40/10/10/25/15)

PE-27 isophoronediisocyanate/diethylene glycol/sodium 2,2-bis(hydroxymethyl)propionate/polyethylene glycol (Mw=400) (48.2/6.9/10.2/34.7; 50/15/15/20)

PE-28 4,4'-diphenylmethanediisocyanate/hexamethylenediisocyanate/ethylene glycol/sodium 2,2bis(hydroxymethyl)butanoate/polyethylene glycol (Mw=1000)/polyethylene glycol (Mw=400) (35.0/5.9/2.2/14.9/35.0/7.0; 40/10/10/25/10/5)

PE-29 4,4'-diphenylmethanediisocyanate/sodium 2,2-bis(hydroxymethyl)propionate/polyethylene glycol (Mw=300)/polyethylene glycol (Mw=400) (47.9/11.9/17.2/23.0; 50/20/15/15)

Of the polymers of the present invention having the recurring unit of Formula (1) and the polymers of the present invention having the recurring unit of Formula (2), the production processes for the vinyl polymer and polyurethane will be described below.

The vinyl polymer can be produced by various polymerizing processes, for example, a solution polymerization, precipitation polymerization, suspension polymerization, block polymerization, and emulsion polymerization. An initiating method for polymerization includes a method in which a radical initiator is used, a method in which light or radial ray is irradiated, and a heat polymerization. These polymerization processes and initiating methods for the polymerization are described in, for example, T. Tsuruta, "High Polymer Synthesis Reaction" revised edition (published by Daily Industry News Paper Co., Ltd., 1971) and T. Ohtsu and M. Kinoshita, "Experimental Method for High Polymer Synthesization" Kagaku Dohjin, published in 1972, pp. 124 to 154.

Of the polymerization processes described above, the solution polymerization process in which a radical initiator is used is particularly preferred. There may be used as a solvent used in the solution polymerization process, water or organic solvents such as, for example, ethyl acetate, methanol, ethanol, 1-propanol, 2-propanol, acetone, dioxane, N,N-dimethylformamide, N,N-dimethylacetamide, toluene, n-hexane, and acetonitrile singly or in a mixture of two or more kinds, or may be used as a mixed solvent with water. Of them, water or a mixture of water and an organic solvent which is miscible with water is particularly preferred in the polymer of the present invention.

A polymerizing temperature is required to be settled in relation to a molecular weight of a polymer formed and a kind of. an initiator. The polymerization is possible at 0° C. to 100° C. and usually, it is carried out in a range of 30° C. to 100° C.

Preferred as the radical initiator which is used for the polymerization, an azo series initiator such as 2,2'-azobisisobutyronitrile, 2,2'-azobis(2,4-dimethylvaleronitrile), 2,2'-azobis(2-amidinopropane)dihydrochloride, and 4,4'-azobis(4-cyanopentanoic acid) and a peroxide series initiator such as benzoyl peroxide, t-butyl hydroperoxide, and potassium persulfate (may be used as a redox initiator in combination with, for example, sodium hydrogensulfite).

A use amount of the polymerization initiator can be adjusted according to a polymerizability of a monomer and a molecular weight needed for a polymer. It falls preferably in a range of 0.01 to 10 mole %, particularly preferably 0.01 to 2.0 mole % based on the monomer.

In synthesizing the polymer of the present invention in a form of a copolymer, all of the monomers to be used may be put in a reaction vessel in the first place and then an initiator may be put to start the polymerization but it is synthesized preferably through a step at which the monomers are added dropwise to a polymerization medium.

The ethylenically unsaturated monomers to be added may be dropped as a mixture of all of two or more kinds of the monomers to be used or may be dropped separately. In dropping, the ethylenically unsaturated monomers may be dissolved in a suitable solvent. An auxiliary solvent may be water, an organic solvent (for example, those described above) or a mixed solvent of water and the above organic solvents.

A time required for dropping can be different according to a polymerization reaction activity and a polymerizing temperature of the ethylenically unsaturated monomers, and it is preferably 5 minutes to 8 hours, particularly preferably 30 minutes to 4 hours. A dropping speed either may be a constant speed during dropping or may suitably be changed within a dropping step. In the case where the ethylenically unsaturated monomers are dropped separately, each dropping time and dropping speed can freely be changed according to necessity. In particular, in the case where the respective ethylenically unsaturated monomers have large differences in a polymerization reactivity, the monomers having a high reactivity are preferably dropped more slowly.

A polymerization initiator either may be added in advance to a polymerization medium or may be added together with the ethylenically unsaturated monomers. Or, the initiator, which is dissolved in a solvent, may be dropped separately from the monomers. Further, two or more kinds of such adding methods may be combined.

A producing process for the polyurethane compound is not particularly limited, and preferably used is a process in which diisocyanate is reacted with a mixture of diol containing the recurring unit of Formula (1) or Formula (2) described above and the other diols.

The synthesis reaction described above is carried out preferably at a temperature of 30° C. to 150° C., particularly preferably 50° C. to 80° C. There are preferably added as a catalyst, tertiary amine (for example, tetramethylethylenediamine and 4-dimethylaminopyridine) and an organic tin compound (tin dibutyl laurate and tin dioctyl laurate) to accelerate a reaction of an isocyanate group with a hydroxyl group.

Further, a suitable organic solvent may be used in a reaction for a purpose of preventing a reaction product from solidifying and becoming high viscous. Those which are inactive to the isocyanate group and dissolve the reaction products are preferably used as the solvent. There can be enumerated as an example of such the preferred solvent, ketones (acetone and methyl ethyl ketone), ethers (tetrahydrofuran, ethyelene glycol dimethyl ether, diethyelene glycol dimethyl ether, and dioxane), halogenated alkyl (chloroform and dichloroethane), aromatic hydrocarbons (benzene, toluene and chlorobenzene), and amides (N,N-dimethylformamide and N,N-dimethylacetamide). The solvent can be removed by a conventional method according to necessity.

A synthesis of polyurethane is favorably carried out by referring to the processes described in "Polymer Chemistry Experimental Method" (written by Y. Iwakura, E. Masuhara, S. Suzuki and H. Okada, Asakura Shoten, 1965) pp. 186 to 187 and 197 to 204, "Polyurethane Handbook" written by Gunter Oertel pp. 21 (1965), "Synthetic High Polymer" V written by S. Murahashi et al, pp. 309 to 359, and "Polyurethane" edited by Bridgestone Tire Co., Ltd. and Nippon Trading Co., Ltd. (Maki Shoten, 1960). Needless to say, an initiator for polyaddition, a concentration, a polyaddition temperature, and a reaction time can be changed widely and easily.

The synthetic examples of the vinyl polymer and polyurethane of the present invention will be shown below.

Synthesis Example 1

(Synthesis of the exemplified Compound PP-2):

MP-3 of 2.5 g, acrylamide 7.5 g, sodium hydrogensulfite of 0.39 g, ethanol of 280 ml, and distilled water of 140 g were charged in a 1 liter three neck flask provided with a stirrer and a reflux condenser, and heating and stirring were applied under a nitrogen gas flow at 70° C.

After an aqueous solution of 20 ml containing potassium persulfate of 0.20 g was added under heating and stirring for 1 hour, there were simultaneously dropped at the same speed over a period of 1.5 hour, a mixed solution of potassium persulfate of 0.60 g, ethanol of 50 ml and distilled water of 50 ml and a mixed solution of MP-3 of 22.5 g, acrylamide of 67.5 g, ethanol of 100 ml and distilled water of 100 g.

After finishing dropping, an aqueous solution of 0.20 g containing potassium persulfate of 0.20 g was added and heating and stirring were further applied at 70° C. for 3 hours.

Ethanol was distilled off from a polymer solution obtained under a reduced pressure. Further, reprecipitation was carried out with a mixed solution of 7 liters of acetone/ethyl acetate (1/1 vol ratio). A powder obtained was filtered off and dried under a reduced pressure, whereby the captioned polymer of 87.0 g was obtained (a weight-average molecular weight was 49,700, which was determined with a gel permeation chromatography).

Synthesis Example 2

(synthesis of the exemplified Compound PE-2):

ME-4 of 2.5 g, acrylamide of 7.5 g, sodium sulfite of 0.39 g, ethanol of 280 ml, and distilled water of 140 g were charged in a 1 liter three neck flask provided with a stirrer and a reflux condenser, and heating and stirring were applied under a nitrogen gas flow at 70° C.

After an aqueous solution of 20 ml containing potassium persulfate of 0.20 g was added under heating and stirring for 1 hour, there were simultaneously dropped at the same speed over a period of 1.5 hour, a mixed solution of potassium persulfate of 0.60 g, ethanol of 50 ml and distilled water of 50 ml and a mixed solution of ME-4 of 22.5 g, acrylamide of 67.5 g, ethanol of 100 ml and distilled water of 100 g.

After finishing dropping, an aqueous solution of 20 ml containing potassium persulfate of 0.20 g was added and heating and stirring was further applied at 70° C. for 3 hours. Ethanol was distilled off from a polymer solution obtained under a reduced pressure. Further, reprecipitation was carried out with a mixed solution of 7 liters of acetone/ethyl acetate (1/1 vol ratio). A powder obtained was filtered off and dried under a reduced pressure, whereby the captioned polymer 90.5 g was obtained a weight-average molecular weight was 47,500, which was determined with a gel permeation chromatography.

Synthesis Example 3

(synthesis of the exemplified Compound PE-26):

In a 300 ml three neck flask provided with a stirrer and a reflux condenser, 4,4'-diphenylmethane-diisocyanate of 19.6 g, hexamethylenediisocyanate of 3.3 g, ethylene glycol of 1.2 g, 2,2-bis(hydroxymethyl)propionic acid of 6.5 g, polyethylene glycol (Mw=600) of 17.6 g, and dimethylacetamide of 70 ml were charged, and the mixture were dissolved at a room temperature under stirring.

Tin di-n-butyl dilaurate of 0.i0 g was added and a mixed solution was heated up to 90° C., followed by continuing heating and stirring for 6 hours. Then, the solution was diluted with dimethylformamide of 30 ml and further, after cooling down to a room temperature, a solution obtained by dissolving potassium hydroxide of 2.7 g in methanol of 100 ml was added.

A polymer solution thus obtained was poured into ethyl acetate of 5 liters to thereby generate a precipitate. It was filtrated and dried, whereby the captioned polyurethane PE-26 was obtained in a yield of 47.3 g.

Next, a producing process for the silver halide emulsion of the present invention will be described.

The silver halide emulsion of the present invention can be produced according to the processes sequence comprising nucleus formation-ripening-grain-growing.

The water soluble polymer which was explained previously may be present in any step during a grain formation. It is present from at least before grain-growing, preferably from before ripening, and further preferably from before the nucleus formation.

The respective processes of the nucleus forming, ripening and grain-growing in the production according to the present invention will be explained below.

1. Nucleus forming:

In general, there are employed for a nucleus formation of a tabular grain, a double jet process in which an aqueous silver salt solution and an aqueous alkali halide solution are added to a reaction vessel containing an aqueous protective colloid solution or a single jet process in which an aqueous silver salt solution is added to a protective colloid solution containing an alkali halide. A process in which an aqueous alkali halide solution is added to a protective colloid solution containing an alkali halide can be employed as well according to necessity. Further, the nucleus formation can be carried out according to necessity by adding a protective colloid solution, a silver salt solution and an aqueous alkali halide solution to the mixing vessel which is disclosed in JP-A-2-44335 and immediately transferring thereof to a reaction vessel.

Further, as disclosed in U.S. Pat. No. 5,104,786, the nucleus formation can be carried out as well by passing an aqueous alkali halide solution and a protective colloid solution through a pipe and adding a silver salt aqueous solution thereto.

In the nucleus forming, the nucleus is formed preferably in a disperse medium in a condition of pBr of 1 to 4 using a protective colloid as the disperse medium. The protective colloid includes gelatin and a protective colloid polymer. With respect to a kind of gelatin, alkali-treated gelatin is usually used. Low molecular weight gelatin may be used and oxidation-treated gelatin is preferably used. Those listed below are suitable as the protective colloid.

(1) Polyvinylpyrrolidone:

Homopolymer of vinylpyrrolidone or a copolymer of acrolein and pyrrolidone, which is shown in French Patent 2031396.

(2) Polyvinyl alcohol:

A homopolymer of vinyl alcohol, organic acid monoester of vinyl alcohol, which is shown in U.S. Pat. No. 3,000,741, maleic ester which is shown in U.S. Pat. No. 3,236,653, or a copolymer of polyvinyl alcohol and polyvinylpyrrolidone, which is shown in U.S. Pat. No. 3,479,189.

(3) Polymer having a thioether group:

The polymers having a thioether group, which are shown in U.S. Pat. Nos. 3,615,624, 3,860,428 and 3,706,564.

(4) Polyvinylimidazole:

A homopolymer of polyvinylimidazole, a copolymer of polyvinylimidazole and polyvinylamide, or the ternary copolymers of acrylamide, acrylic acid and vinylimidazole, which are shown in JP-B-43-7561 (the term "JP-B" as used herein means an examined Japanese patent publication), and German Patents 2012095 and 2012970.

(5) Polyethylenimine.

(6) Acetal polymer:

The water soluble polyvinylacetals shown in U.S. Pat. No. 2,358,836, polyvinylacetals having a carboxyl group, which are shown in U.S. Pat. No. 3,003,879, or the polymers shown in British Patent 771155.

(7) Amino polymer:

The amino polymers shown in U.S. Pat. Nos. 3,345,346, 3,705,504 and 4,350,759 and German patent 2138872, the polymers having a quaternary amine, which are shown in British Patent 1413125 and U.S. Pat. No. 3,425,836, the polymers having an amino group and a carboxyl group, which are shown in U.S. Pat. No. 3,511,818, and the polymers shown in U.S. Pat. No. 3,832,185.

(8) Polyacrylamide polymer:

A homopolymer of acrylamide, the copolymers of polyacrylamide and imidized polyacrylamide, which are shown in U.S. Pat. No. 2,541,474, the copolymers of acrylamide and methcrylamide, which are shown in German Patent 1202132, the acrylamide polymers partially converted to amino, which are shown in U.S. Pat. No. 3,284,207, and the substituted acrylamide polymers shown in JP-B-45-14031, U.S. Pat. Nos. 3,713,834 and 3,746,548, and British Patent 788343.

(9) Polymer having hydroxyquinoline:

The polymers having hydroxyquinoline, which are shown in U.S. Pat. Nos. 4,030,929 and 4,152,161.

(10) Others:

The vinyl polymers having an azaindene group, which are shown in JP-A-59-8604, the polyalkylene oxide derivatives shown in U.S. Pat. No. 2,976,150, the polyvinylaminimide polymers shown in U.S. Pat. No. 4,022,623, the polymers shown in U.S. Pat. Nos. 4,294,920 and 4,089,688, polyvinylpyridines shown in U.S. Pat. No. 2,484,459, the vinyl polymers having an imidazole group, which are shown in U.S. Pat. No. 3,520,857, the vinyl polymers having a triazole group, which are shown in JP-B-60-658, and water soluble polyalkyleneaminotriazoles shown in Zeit Schricht Bisenscaftriche Photographie Vol. 45, pp. 43 (1950).

A concentration of the disperse medium is preferably 10 weight % or less, more preferably 1 weight % or less.

A temperature in the nucleus formation is preferably 5° to 60° C. and in the case where the fine tabular grains having an average grain size of 0.5 μm or less are formed, it is more preferably 5° to 48° C.

The dispersing medium has pH of 8 or less, preferably 6 or less.

With respect to a composition of an alkali halide solution added, an $I^-$ content based on $Br^-$ is not higher than a solid solution limit of AgBrI formed, preferably 10 mole % or less.

The polymer of the present invention having the recurring unit represented by Formula (1) and the polymer of the present invention having the recurring unit represented by Formula (2) can be used in an amount of 0.1 time or more and 50 times or less, preferably 0.1 time or more and 30 times or less by weight with respect to an amount of silver nitrate in the nucleus formation.

A ratio of the polymer having the recurring unit represented by Formula (1) to the polymer having the recurring unit represented by Formula (2) is 2:98 to 98:2, preferably 5:95 to 95:5, and particularly preferably 10:90 to 90:10 in terms of a weight ratio.

2. Ripening:

In the nucleus formation in process 1, the fine grains other than the tabular grains (in particular, octahedron and a singlet twin grain) are formed. The grains other than the tabular grains are required to be disappeared before superseding a grain-growing step described below to obtain the nuclei which are of a form to become the tabular grain and has a good monodispersibility. It is well known that in order to make this possible, Ostwald ripening is carried out following the nucleus formation.

A pBr is adjusted immediately after the nucleus formation and then, a temperature is elevated to carry out the ripening until a hexagonal tabular grain ratio is maximized. A protective colloid concentration is adjusted in this step. The protective colloid concentration is preferably 1 to 10 weight %. The protective colloid used herein is suitably gelatin and a protective colloid polymer. Gelatin is usually alkali-treated, and oxidation-treated may also be used. Those described in process 1 are preferably used as the protective colloid polymer.

A temperature in ripening is 40 to 80° C., preferably 50° to 80° C., and pBr is 1.2 to 3.0.

Herein, a silver halide solvent may be added in order to allow the grains other than of the tabular form to rapidly disappear. In this case, a concentration of the silver halide solvent is preferably 0.3 mol/liter or less, more preferably 0.2 mol/liter or less. In case of using as a direct reversal emulsion, the silver halide solvent such as a thioether compound which is used at a neutral or acid side is preferred as the silver halide solvent rather than $NH_3$ which is used in an alkaline condition.

The ripening is thus carried out to prepare only the tabular grain by almost 100%.

After finishing the ripening, the silver halide solvent is removed in the following manner in the case where the silver halide solvent is unnecessary in the following grain-growing step.

(1) In the case where an alkaline silver halide solvent is such as $NH_3$, acid having a large solubility product to $Ag^+$, such as $HNH_3$, is added to make it ineffective.

(2) In case of a thioether series silver halide solvent, an oxidizing agent such as $H_2O_2$ is added to make it ineffective as described in JP-A-60-136736.

3. Grain-Growing:

pBr in a crystal growing process following the ripening process is maintained preferably at 1.4 to 3.5. The addition speeds of $Ag^+$ and a halogen ion at a crystal growing stage are settled so that a crystal growing speed of 20 to 100%, preferably 30 to 100% based on a critical crystal growing speed is maintained. In this case, the addition speeds of a silver ion and a halogen ion are increased in proportion to a crystal growth, wherein either the addition speeds of an aqueous silver salt solution and an aqueous halide solution may be increased or concentrations of the aqueous solutions may be increased, as described in JP-B-48-36890 and JP-B-52-16364.

An iodide content in AgX which is deposited on the nucleus at the grain-growing stage is preferably 0 mole % to a critical solid solution concentration.

Silver halide in the present invention includes, for example, silver bromide, silver iodobrimide, and silver chlorobromide and silver chloroiodobromide each having a silver chloride content of 30 mole % or less.

The silver halide emulsion of the present invention can be provided on a support in one layer or more together with the other emulsions according to necessity. Further, it can be provided not only on one side of the support but also on the both sides thereof. It can be provided as well in a multi-layer in a form of the emulsions each having a different color sensitivity.

The silver halide emulsion of the present invention can be used a black and white silver halide photographic material (for example, an X ray light-sensitive material, a lithographic light-sensitive material and a black-and-white photographic negative film) and a color photographic material (for example, a color negative film, a color reversal film and a color paper). Further, it can be used as well for a diffusion transfer type light-sensitive material (for example, a color diffusion transfer element and a silver salt diffusion transfer element) and a heat developing light-sensitive material (black-and-white and color).

In general, those described in Research Disclosure No. 308119 (1989) can be applied to various techniques and the inorganic and organic materials which can be used for the silver halide photographic material of the present invention and the silver halide photographic material in which it is used.

In addition thereto, to be more concrete, for example, the techniques and the inorganic and organic materials which can be used for the silver halide photographic material to which the silver halide photographic material of the present invention can be applied are described at the following portions of European Patent 436,938A2 and in the patents which are cited below.

| Item | Corresponding portions |
|---|---|
| 1) Layer structure | pp. 146, 34th line to pp. 147, 25th line. |
| 2) Silver halide emulsion | pp. 147, 26th line to pp. 148, 12th line. |
| 3) Yellow coupler | pp. 137, 35th line to pp. 146, 33rd line and pp. 149, 21st line to 23rd line. |
| 4) Magenta coupler | pp. 149, 24th line to 28th line; and pp. 3, 5th line to pp. 25, 55th line of European Patent 421,453A1. |
| 5) Cyan coupler | pp. 149, 29th line to 33rd line; and pp. 3, 28th line to pp. 40, 2nd line of European Patent 432,80A2. |
| 6) Polymer coupler | pp. 149, 34th line to 38th line; and pp. 113, line 39th to pp. 123, 37th line of European Patent 435,334A2. |
| 7) Colored coupler | pp. 53, 42nd line to pp. 137, 34th line and pp. 149, 39th line to 45th line. |
| 8) Other functional couplers | pp. 7, 1st line to pp. 53, 41st line; pp. 149, 46th line to pp. 150, 3rd line; and pp. 3, 1st line to pp. 29, 50th line of European Patent 435,334A2. |
| 9) Preservative and fungicide | pp. 150, 25th line to 28th line. |
| 10) Formaline scavenger | pp. 149, 15th line to 17th line. |
| 11) Other additives | pp. 153, 38th line to 47th line; and pp. 75, 21st line to pp. 84, 56th line and pp. 27, 40th line to pp. 37, 40th line of European Patent 421,453A1. |
| 12) Dispersing method | pp. 150, 4th line to 24th line. |
| 13) Support | pp. 150, 32nd line to 34th line. |
| 14) Film thickness & film physical properties | pp. 150, 35th line to 49th line. |
| 15) Color developing process | pp. 150, 50th line to pp. 150, 47th line. |
| 16) Desilver process | pp. 151, 48th line to pp. 152, 53rd line. |
| 17) Automatic developing machine | pp. 152, 54th line to pp. 153, 2nd line. |
| 18) Rinsing and stabilizing process | pp. 153, 3rd line to 37th line |

The tabular silver halide emulsion of the present invention thus obtained has the characteristics that:

(1) a grain form is uniform, (2) a projected area diameter is monodispersed, and (3) a grain thickness is uniform, and a chemical sensitization can optimally be set up to the respective grains.

In the case where large grains, medium grains and small grains are simultaneously coated in a high sensitive layer, a medium sensitive layer and a low sensitive layer, respectively, the multi-layer effect thereof can sufficiently be revealed, and there can be provided a light-sensitive silver halide emulsion having the characteristics which are excellent in a sensitivity, a graininess, a sharpness and a preservability.

The present invention will be further explained with reference to the examples.

The present invention will concretely be explained below with reference to the examples but the embodiment of the present invention will not be limited thereto.

EXAMPLE 1

An aqueous solution of 1 liter containing KBr of 0.15 g, oxidation-treated gelatin of 0.4 g, 1N $HNO_3$ of 16.8 ml, the compound (PP-2) of 3 g, and the compound (PE-2) of 3 g was maintained at 45° C. A silver nitrate solution of 14 ml of 0.165 mol/liter and a potassium bromide solution of 14 ml of 0.155 mol/liter were added to this solution for one minute while stirring. One minute after adding, KBr of 2.98 g was added and then, a temperature was elevated to 60° C. for 9 minutes. A 20% ammonium sulfate solution of 17 ml and a 2.5N NaOH solution of 27 ml were added immediately after elevating the temperature. After stirring for 9 minutes, oxidation-treated gelatin of 16.7 g and 1N $HNO_3$ of 43 ml were added. After stirring for 2 minutes, a silver nitrate solution of 75 ml of 0.165 mol/liter and a potassium bromide solution of 83 ml of 0.155 mol/liter were added for 5 minutes. After stirring for 2 minutes, a silver nitrate solution of 1.21 mol/liter was added at an initial flow rate of 1 ml/minute while accelerating a flow amount so that 627 ml could be added for 88 minutes, wherein a potassium bromide solution of 1.21 mol/liter was added while controlling a flow rate so that a silver/saturated calomel interelectrode potential became −40 mV. This emulsion was washed with water and dispersed. A replica image of the emulsion obtained was observed with TEM (FIG. 1). It can be found that the tabular grains which were formed according to the present invention are monodispersed and that a degree of a distorted form like Comparative Example 1 is small.

Comparative Example 1

The compound PLURONIC TM31R1® (produced by BASF, U.S.A.) of 0.11 g which was used in European Patent 514742A was used in place of the compound PP-2 and the compound PE-2 which were used in Example 1 in the present invention to prepare the emulsion grains, and the same processing as that described above was carried out.

EXAMPLE 2

An aqueous solution of 1 liter containing KBr of 0.15 g, oxidation-treated gelatin of 0.4 g, 1N $HNO_3$ of 16.8 ml, the compound (PP-2) of 3 g, and the compound (PE-2) of 3 g was maintained at 45° C. A silver nitrate solution of 14 ml of 0.165 mol/liter and a potassium bromide solution of 14 ml of 0.155 mol/liter were added to this solution for one minute while stirring. One minute after adding, KBr of 2.98 g was added and then, a temperature was elevated to 60° C. for 9 minutes. A 20% ammonium sulfate solution of 17 ml and a 2.5N NaOH solution of 27 ml were added immediately after elevating the temperature. After stirring for 9 minutes, oxidation-treated gelatin of 16.7 g and 1N $HN_3O$ of 43 ml were added. After stirring for 2 minutes, a silver nitrate solution of 75 ml of 0.165 mol/liter and a potassium bromide solution of 83 ml of 0.155 mol/liter were added for 5 minutes. After stirring for 2 minutes, a silver nitrate solution of 1.21 mol/liter was added at an initial flow rate of 1 ml/minute while accelerating a flow amount so that 900 ml could be added for 107 minutes, wherein a potassium bromide solution of 1.21 mol/liter was added while controlling a flow rate so that a silver/saturated calomel interelectrode potential became −40 Mv. This emulsion was washed with water and dispersed. A replica image of the emulsion obtained was observed with TEM. The characteristics of the emulsion which was obtained according to the present invention were shown in Table 1 in comparison with Comparative Example 2. While the tabular grains formed according to the present invention were monodispersed as was the case with Comparative Example 1 and had a small degree of a distorted form as was the case with that shown in FIG. 1. The grains which had different side lengths and were of a distorted form were considerably mixed in the grains formed in Comparative Example 1.

Comparative Example 2

The compound PLURONIC TM31R1 of 0.11 g which was used in European Patent 514742A was used in place of the compound PP-2 and the compound PE-2 which were used in Example 2 in the present invention to prepare the emulsion grains.

TABLE 1

| | Example 2 | Comp. Example 2 |
|---|---|---|
| Projected area ratio of tabular grains (%) | 99.8 | 99.7 |
| Average projected area diameter (μm) | 2.28 | 2.39 |
| Average thickness (μm) | 0.121 | 0.104 |
| Average aspect ratio | 18.8 | 23.0 |
| Fluctuation coefficient (%) | 4.6 | 4.8 |

EXAMPLE 3

The sensitizing dye 3,3-dimethyl thiazolinodicarbocyaninebromide, was added to the emulsion prepared in Example 1 in an amount of 90% of a saturated adsorption amount, and pAg was adjusted to 8.0. After aging for 20 minutes, pAg was adjusted to 8.5 and a methanol solution containing 0.005 weight % of teiethylthiourea was added at a constant speed by $0.8\times10^{-5}$ mol/mol AgBr over a period of 10 minutes, followed by aging for 10 minutes. Subsequently, a gold sensitizer (gold thiocyane complex) was added by $0.3\times10^{-5}$ mol/mol AgBr and aging was carried out for 50 minutes. A temperature was lowered and the emulsion was washed twice with water of pBr 1.6 to remove the unreacted sulfur sensitizer. Then, after washing twice with water of pAg 5.0 to remove the dye, the emulsion was further washed once with water and redispersed. An anti-fogging agent TAI (4-hydroxy-6-methyl-1,3,3a,7-tetraazaindene) and a coating aid were added and the emulsion was coated over a triacetyl cellulose film support.

Dye 1

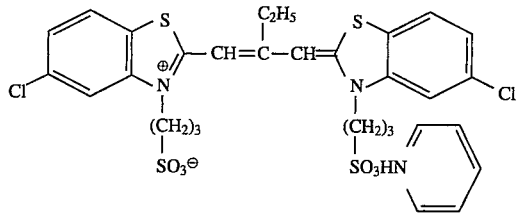

Comparative Example 3

The emulsion prepared in Comparative Example 2 was subjected to the same chemical sensitization and spectral sensitization as those in Example 3 and was coated over a triacetyl cellulose film support.

The coated films, thus obtained, were subjected to a wedge exposing to a tungsten light having a color temperature of 5500° C. for 1/100 second provided with a filter, and were developed in a surface developing solution (MAA-1) at 20° C. for 10 minutes.

| Surface developing solution: | |
|---|---|
| Metol | 2.5 g |
| L-Ascorbic acid | 10.0 g |
| Potassium bromide | 1.0 g |
| Navox (manufactured by Fuji Photo Film Co., Ltd.) | 35.0 g |
| Water was added to | 1000 ml |

The sensitivities which were determined from the characteristic curves obtained were as shown in Table 2. It can be found that the emulsion of the present invention has the good sensitivity.

TABLE 2

| | Relative sensitivity* |
|---|---|
| Example 3 | 106 |
| Comp. Example 3 | 100 |

*The sensitivity was expressed by a reciprocal of an exposure giving a density of fog + 0.2, which was shown in terms of lux · second.

EXAMPLE 4

Preparation of the emulsion:

An aqueous solution of 1 liter containing oxidation-treated gelatin of 0.41 g, 4N nitric acid of 4.2 ml, KBr of 0.73 g, and the compounds (PP-2) of 2.0 g, and (PE-2) of 2.5 g of the present invention was charged into a reaction vessel and stirred at 45° C.

An aqueous solution of 2.75 ml containing $AgNO_3$ of 0.37 g and an aqueous solution of 2.83 ml containing KBr of 0.27 g were added to this solution by a double jet method over a period of one minute while maintaining a temperature of 45° C. One minute later, an aqueous solution of 19.2 ml containing KBr of 2.29 g was added and the temperature was elevated to 60° C. over a period of 9 minutes. A mixed solution of $(NH_4)_2SO)_4$ of 3.37 g and a 2.5N NaOH solution of 26.7 ml was added and stirring was carried out for 9 minutes. Further, an aqueous solution of 94.2 ml containing oxidation-treated gelatin of 16.7 g and 4N nitric acid of 10.8 ml was added over a period of 2 minutes. Then, an aqueous solution of 7.5 ml containing $AgNO_3$ of 1.02 g and an aqueous solution of 8.3 ml containing KBr of 0.79 g were added at a fixed speed over a period of 5 minutes. Thereafter, an aqueous solution of 474.7 ml containing $AgNO_3$ of 29 g and an aqueous solution of 474.7 ml containing KBr of 95 g were simultaneously added at the constantly accelerated flow speeds starting from the initial speeds of 1.5 ml/min and 1.62 ml/min, respectively, over a period of 64 minutes.

An aqueous solution of 290 ml containing KI of 2.9 g was added singly over a period of 2 minutes. Two minutes later, an aqueous solution of 253.3 ml containing $AgNO_3$ of 68.8 g and an aqueous solution of 252 ml containing KBr of 50.3 g were added at a fixed flow amount over a period of 19 minutes.

Then, desalting was carried out by a conventional flocculation method, and after adjusting pH and pAg to 6.5 and 8.5, respectively, at 40° C., an optimum chemical sensitization was carried out with sodium thiosulfate, chloroauric acid and potassium thiocyanate in the presence of the sensitizing dyes (S-6 and S-7 described below) at 65° C., whereby the tabular AgBrI Emulsion;1 (AgI content=1.5 mole %) was obtained. The grains obtained had an average projected diameter of 2.05 μm and an average grain thickness of 0.135 μm; 99% of the projected area of the whole grains having a projected area-corresponding circle diameter of 0.2 μm or more was shared by the tabular grains; and an average aspect ratio was 15.2 and a fluctuation coefficient of grain diameter was 4.5%.

Next, the Emulsions-2 to 5 of the present invention were prepared in the same manner as that in the Emulsion-1, except that the compounds shown in Table 3 were used in place of the Compounds PP-2 and PE-2 of the present invention, and the Comparative Emulsion-a was prepared in the same manner as that in the Emulsion-1, except that the compound PLURONIC TM31R1$^R$ of 0.13 g which was used in European Patent 514,742A was used in place of PP-2 and PE-2.

The characteristics of the emulsions, thus obtained, are shown in Table 3.

TABLE 3

| Emulsion | Polymer used for preparing emulsion | | Average projected circle-corresponding | Average grain thickness | Average aspect | Ratio (%) of tabular grains sharing in | Fluctuation coefficient (%) in grain |
|---|---|---|---|---|---|---|---|
| No. | Kind | Amount | diameter (μm) | (μm) | ratio | projected area | diameter |
| 1 (Inv.) | PP-2 | 2.0 g | 2.05 | 0.135 | 15.2 | 99 | 4.5 |
| | PE-2 | 2.5 g | | | | | |
| 2 (Inv.) | PP-6 | 2.0 g | 2.08 | 0.138 | 15.1 | 100 | 4.7 |
| | PE-3 | 2.0 g | | | | | |
| 3 (Inv.) | PP-8 | 1.8 g | 2.10 | 0.128 | 16.4 | 100 | 4.3 |
| | PE-8 | 3.0 g | | | | | |
| 4 (Inv.) | PP-2 | 2.0 g | 2.00 | 0.140 | 14.3 | 99 | 5.8 |
| | PE-16 | 2.0 g | | | | | |
| 5 (Inv.) | PP-17 | 1.5 g | 2.10 | 0.131 | 16.0 | 98 | 6.2 |
| | PE-25 | 2.0 g | | | | | |
| a (Comp.) | * | 0.13 g | 2.05 | 0.133 | 15.4 | 99 | 4.9 |

* PLURONIC TM31R1

Preparation of the coated samples:

There were added to each of the emulsions thus obtained, dodecylbenzenesulfonate as a coating aid, p-vinylbenzenesulfonate as a thickener, a vinylsulfone series compound as a hardener, and a polyethylene oxide series compound as a photographic characteristic improver to thereby prepare the emulsion coating solutions. Subsequently, those coating solutions were separately coated evenly on a polyester base provided with a subbing processing, and a surface protective layer consisting mainly of an aqueous gelatin solution was coated thereon, to thereby prepare the coated Samples 101 to 106 containing the Emulsions-1 to 5 and the Emulsion-a, wherein the Samples-101 to 106 each had a coated silver amount of 4.0 g/m$^2$, a gelatin coated amount of 1.3 g/m$^2$ in a protective layer, and a gelatin coated amount of 2.7 g/m$^2$ in an emulsion layer.

The coated materials, thus obtained, were subjected to the following experiment in order to evaluate thereof.

First, the sample pieces of the coated Samples 101 to 106 were subjected to a wedge exposing at an exposure of 10 CMS for 1/100 second and were developed in a processing solution having the following composition at 20° C. for 4 minutes, followed by subjecting them to a sensitometry after fixing, washing and drying, to thereby determine a sensitivity from a reciprocal of an exposure which gives a density of a fog +0.1.

Each two sets of the test pieces of the coated Samples 101 to 106 were prepared and subjected to a wedge exposing for 1/100 second. Then, one set was stored in an atmosphere of 50° C. and 60% RH for 5 days, and the remaining one set was stored in a freezer as a control. The text pieces were subjected to a development processing in the same manner as that described above to evaluate a latent image preservability.

The results are shown in Table 4.

TABLE 4

| Coated Sample No. | Emulsion No. | Sensitivity *2) | Latent image *1) preservability (%) |
|---|---|---|---|
| 101 (Inv.) | 1 | 105 | 90 |
| 102 (Inv.) | 2 | 105 | 92 |
| 103 (Inv.) | 3 | 103 | 93 |
| 104 (Inv.) | 4 | 100 | 90 |
| 105 (Inv.) | 5 | 103 | 85 |
| 106 (Comp.) | a | 100 | 75 |

*1) The latent image preservability was expressed by a relative value to a sensitivity of each of the controls of the samples.
*2) The sensitivity was expressed by a relative value to the sensitivity of the control of Sample 106, which was set as 100.

| Processing solution: | |
|---|---|
| 1-Phenyl-3-pyrazolidone | 0.5 g |
| Hydroquinone | 10 g |
| Disodium ethylenediaminetetraacetate | 2 g |
| Potassium sulfite | 60 g |
| Boric acid | 4 g |
| Potassium carbonate | 20 g |
| Sodium bromide | 5 g |
| Diethylene glycol | 20 g |
| pH was adjusted to 10.0 with sodium hydroxide | |
| Water was added to | 1 liter |

It is apparent from the results shown in Table 4 that the tabular grains which were prepared using the compounds of the present invention have an equal or higher sensitivity and excel more in a latent image preservability than the comparative emulsion.

EXAMPLE 5

Preparation of Sample 201

The respective layers having the following compositions were provided over a 127 μm thick cellulose triacetate film support provided with subbing to thereby prepare the multilayer color light-sensitive material Sample 201. The numerals show the addition amounts per m$^2$. The effects of the compounds added are not limited to the applications described.

| | | |
|---|---|---|
| First layer: an anti-halation layer | | |
| Black colloidal silver | | 0.20 g |
| Gelatin | | 1.9 g |
| UV absorber U-1 | | 0.1 g |
| UV absorber U-3 | | 0.04 g |
| UV absorber U-4 | | 0.1 g |
| High boiling organic solvent Oil-1 | | 0.1 g |
| Fine crystal solid matter dispersion of Dye-1 | | 0.1 g |
| Second layer: an intermediate layer | | |
| Gelatin | | 0.40 g |
| Compound Cpd-C | | 5 mg |
| Compound Cpd-J | | 5 mg |
| Compound Cpd-K | | 3 mg |
| High boiling organic solvent Oil-3 | | 0.1 g |
| Dye D-4 | | 0.8 mg |
| Third layer: an intermediate layer | | |
| Silver iodobromide fine grains emulsion, the surface and inside of which were fogged (average grain size: 0.06 μm, a fluctuation coefficient: 18%, AgI content: 1 mole %) | silver amount | 0.05 g |
| Yellow colloidal silver | silver amount | 0.05 g |
| Gelatin | | 0.4 g |
| Fourth layer: a low red-sensitive layer | | |
| Emulsion A | silver amount | 0.1 g |
| Emulsion B | silver amount | 0.4 g |
| Silver iodobromide fine grains emulsion, the inside of which was fogged (average grain size: 0.06 μm, a fluctuation coefficient: 18%, AgI content: 1 mole %) | silver amount | 0.05 g |
| Gelatin | | 0.8 g |
| Coupler C-1 | | 0.15 g |
| Coupler C-2 | | 0.05 g |
| Coupler C-3 | | 0.05 g |
| Coupler C-9 | | 0.05 g |
| Compound Cpd-C | | 5 mg |
| Compound Cpd-J | | 5 mg |
| High boiling organic solvent Oil-2 | | 0.1 g |
| Additive PM-1 | | 0.1 g |
| Fifth layer: a medium red-sensitive layer | | |
| Emulsion C | silver amount | 0.5 g |
| Silver iodobromide fine grains emulsion, the inside of which was fogged (average grain size: 0.06 μm, a fluctuation coefficient: 18%, AgI content: 1 mole %) | silver amount | 0.05 g |
| Gelatin | | 0.8 g |
| Coupler C-1 | | 0.2 g |
| Coupler C-2 | | 0.05 g |
| Coupler C-3 | | 0.2 g |
| High boiling organic solvent Oil-2 | | 0.1 g |
| Additive PM-1 | | 0.1 g |
| Sixth layer: a high red-sensitive layer | | |
| Emulsion D | silver amount | 0.4 g |
| Gelatin | | 1.1 g |
| Coupler C-1 | | 0.3 g |
| Coupler C-2 | | 0.1 g |
| Coupler C-3 | | 0.7 g |
| Additive PM-1 | | 0.1 g |
| Seventh layer: an intermediate layer | | |
| Gelatin | | 0.6 g |
| Additive M-1 | | 0.3 g |
| Anti-color mixing agent Cpd-1 | | 2.6 mg |
| Dye D-5 | | 0.02 g |

-continued

| | | |
|---|---|---|
| Compound Cpd-J | | 5 mg |
| High boiling organic solvent Oil-1 | | 0.02 g |
| Eighth layer: an intermediate layer | | |
| Silver iodobromide fine grains emulsion, the inside of which was fogged (average grain size: 0.06 μm, a fluctuation coefficient: 16%, AgI content: 0.3 mole %) | silver amount | 0.02 g |
| Yellow colloidal silver | silver amount | 0.02 g |
| Gelatin | | 1.0 g |
| Additive PM-1 | | 0.2 g |
| Anti-color mixing agent Cpd-A | | 0.1 g |
| Compound Cpd-C | | 0.1 g |
| Ninth layer: a low green-sensitive layer | | |
| Emulsion E | silver amount | 0.3 g |
| Emulsion F | silver amount | 0.2 g |
| Silver iodobromide fine grains emulsion, the surface and inside of which were fogged (average grain size: 0.06 μm, a fluctuation coefficient: 18%, AgI content: 1 mole %) | silver amount | 0.04 g |
| Gelatin | | 0.5 g |
| Coupler C-4 | | 0.1 g |
| Coupler C-7 | | 0.05 g |
| Coupler C-8 | | 0.20 g |
| Compound Cpd-B | | 0.03 g |
| Compound Cpd-D | | 0.02 g |
| Compound Cpd-E | | 0.02 g |
| Compound Cpd-F | | 0.04 g |
| Compound Cpd-J | | 10 mg |
| Compound Cpd-L | | 0.02 g |
| High boiling organic solvent Oil-1 | | 0.1 g |
| High boiling organic solvent Oil-2 | | 0.1 g |
| Tenth layer: a medium green-sensitive layer | | |
| Emulsion F | silver amount | 0.3 g |
| Emulsion G | silver amount | 0.1 g |
| Silver iodobromide fine grains emulsion the inside of which was fogged (average grain size: 0.06 μm, a fluctuation coefficient: 18%, AgI content: 1 mole %) | silver amount | 0.04 g |
| Gelatin | | 0.6 g |
| Coupler C-4 | | 0.1 g |
| Coupler C-7 | | 0.2 g |
| Coupler C-8 | | 0.1 g |
| Compound Cpd-B | | 0.03 g |
| Compound Cpd-D | | 0.02 g |
| Compound Cpd-E | | 0.02 g |
| Compound Cpd-F | | 0.05 g |
| Compound Cpd-L | | 0.05 g |
| High boiling organic solvent Oil-2 | | 0.01 g |
| Eleventh layer: a high green-sensitive layer | | |
| Emulsion H | silver amount | 0.5 g |
| Gelatin | | 1.0 g |
| Coupler C-4 | | 0.3 g |
| Coupler C-7 | | 0.1 g |
| Coupler C-8 | | 0.1 g |
| Compound Cpd-B | | 0.08 g |
| Compound Cpd-E | | 0.02 g |
| Compound Cpd-F | | 0.04 g |
| Compound Cpd-K | | 5 mg |
| Compound Cpd-L | | 0.02 g |
| High boiling organic solvent Oil-1 | | 0.02 g |
| High boiling organic solvent Oil-2 | | 0.02 g |
| Twelfth layer: an intermediate layer | | |
| Gelatin | | 0.6 g |
| Compound Cpd-L | | 0.05 g |
| High boiling organic solvent Oil-1 | | 0.05 g |

-continued

| | | |
|---|---|---|
| Thirteenth layer: a yellow filter layer | | |
| Yellow colloidal silver | silver amount | 0.07 g |
| Gelatin | | 1.1 g |
| Anti-color mixing agent Cpd-A | | 0.01 g |
| Compound Cpd-L | | 0.01 g |
| High boiling organic solvent Oil-1 | | 0.01 g |
| Fine solid crystal dispersion of dye E-2 | | 0.05 g |
| Fourteenth layer: an intermediate layer | | |
| Gelatin | | 0.6 g |
| Fifteenth layer: a low blue-sensitive layer | | |
| Emulsion I | silver amount | 0.4 g |
| Emulsion J | silver amount | 0.2 g |
| Gelatin | | 0.8 g |
| Coupler C-5 | | 0.2 g |
| Coupler C-6 | | 0.1 g |
| Coupler C-10 | | 0.4 g |
| Sixteenth layer: a medium blue-sensitive layer | | |
| Emulsion K | silver amount | 0.4 g |
| Gelatin | | 0.9 g |
| Coupler C-5 | | 0.1 g |
| Coupler C-6 | | 0.1 g |
| Coupler C-10 | | 0.6 g |
| Seventeenth layer: a high blue-sensitive layer | | |
| Emulsion-1 described in Example-1 | silver amount | 0.4 g |
| Gelatin | | 1.2 g |
| Coupler C-5 | | 0.1 g |
| Coupler C-6 | | 0.1 g |
| Coupler C-10 | | 0.6 g |
| High boiling organic solvent Oil-2 | | 0.1 g |
| Eighteenth layer: the first protective layer | | |
| Gelatin | | 0.7 g |
| UV absorber U-1 | | 0.2 g |
| UV absorber U-2 | | 0.05 g |
| UV absorber U-5 | | 0.3 g |
| Formalin scavenger Cpd-H | | 0.4 g |
| Dye D-1 | | 0.15 g |
| Dye D-2 | | 0.05 g |
| Dye D-3 | | 0.1 g |
| Nineteenth layer: the second protective layer | | |
| Colloidal silver | silver amount | 0.1 mg |
| Silver iodobromide fine grains emulsion (average grain size: 0.06 μm, AgI content: 1 mole %) | silver amount | 0.1 g |
| Gelatin | | 0.4 g |
| Twentieth layer: the third protective layer | | |
| Gelatin | | 0.4 g |
| Polymethyl methacrylate (average grain size: 1.5 μm) | | 0.1 g |
| Copolymer of methyl methacrylate and acrylic acid (4:6) (average grain size: 1.5 μm) | | 0.1 g |
| Silicon oil | | 0.03 g |
| Surface active agent W-1 | | 3.0 mg |
| Surface active agent W-2 | | 0.03 g |

In addition to the above components, the additives F-1 to F-8 were added to all of the emulsion layers. Further, in addition to the above components, gelatin hardener H-1 and the surface active agents W-3, W-4, W-5 and W-6 for coating and emulsifying were added to each of the layers.

Further, phenol, 1,2-benzisothiazline-3-one, 2-phenoxyethanol, phenethyl alcohol, and butyl p-benzoate were added as a preservative and a fungicide.

The silver iodobromide emulsions used for Sample 201 are as shown in Table 5.

TABLE 5

| Emulsion | Grain form | Average grain size (μm) | Fluctuation coefficient (%) | AgI content (%) |
|---|---|---|---|---|
| A | Monodispersed tetradecahedral grains | 0.28 | 16 | 3.7 |
| B | Monodispersed cubic grains | 0.35 | 10 | 3.3 |
| C | Monodispersed tabular grains (average aspect ratio: 4.0) | 0.47 | 18 | 5.0 |
| D | Monodispersed tabular grains (average aspect ratio: 7.0) | 0.68 | 16 | 2.0 |
| E | Monodispersed cubic grains | 0.20 | 16 | 4.0 |
| F | Monodispersed cubic grains | 0.35 | 11 | 3.5 |
| G | Monodispersed cubic grains | 0.45 | 9 | 3.5 |
| H | Monodispersed tabular grains (average aspect ratio: 7.0) | 0.80 | 13 | 1.5 |
| I | Monodispersed tetradecahedral grains | 0.30 | 18 | 4.0 |
| J | Monodispersed cubic grains | 0.40 | 14 | 3.5 |
| K | Monodispersed tabular grains (average aspect ratio: 7.0) | 0.55 | 13 | 3.5 |
| 1 | Monodispersed tabular grains (average aspect ratio: 15.0 | 0.93 | 5.0 | 1.5 |

Note:
The average aspect ratio is obtained by averaging the grain diameter/grain thickness ratios of the whole grains, and it is obtained by a convenient method as a ratio of an average diameter of the whole grains to an average thickness of the whole grains.

The sensitizing dyes were added as shown in the following Table 6 immediately before chemically sensitizing the Emulsions A to K and L.

TABLE 6

| Emulsion | Sensitizing dye added | Added amount per mol of silver halide (m · mol) |
|---|---|---|
| A | S-1 | 0.44 |
| | S-3 | 0.04 |
| B | S-2 | 0.44 |
| | S-3 | 0.01 |
| C | S-1 | 0.26 |
| | S-3 | 0.02 |
| D | S-1 | 0.18 |
| | S-8 | 0.01 |
| | S-3 | 0.01 |
| E | S-4 | 0.47 |
| | S-5 | 0.15 |
| | S-4 | 0.31 |
| | S-5 | 0.09 |
| G | S-4 | 0.30 |
| | S-5 | 0.09 |
| H | S-10 | 0.47 |
| | S-5 | 0.06 |
| | S-9 | 0.13 |
| I | S-7 | 0.27 |
| | S-6 | 0.07 |
| J | S-7 | 0.29 |
| | S-6 | 0.09 |
| K | S-7 | 0.50 |
| | S-6 | 0.15 |
| L | S-7 | 0.30 |
| | S-6 | 0.10 |

C-1
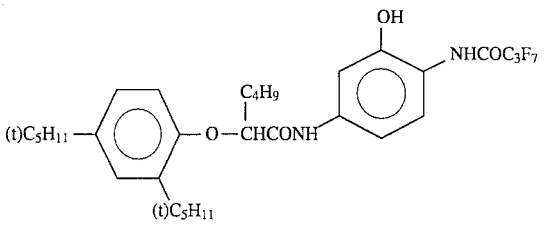
C-2
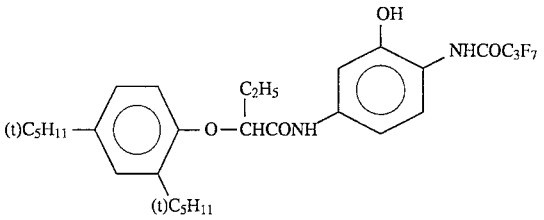
C-3
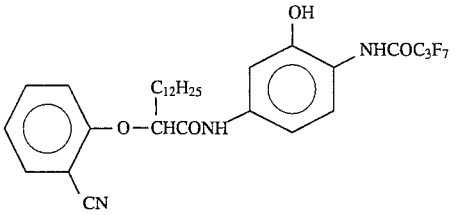
C-4
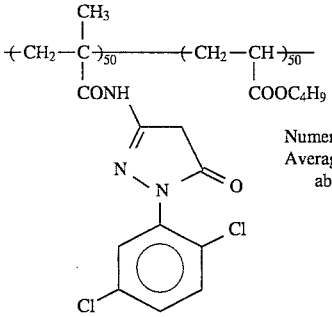
Numeral; weight %.
Average molecular weight: about 25,000.
C-5
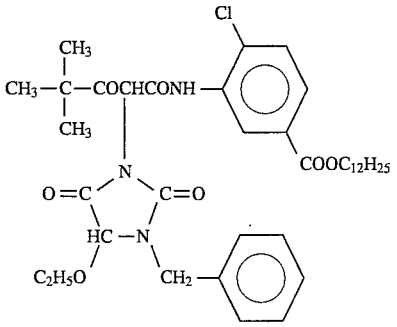
C-6
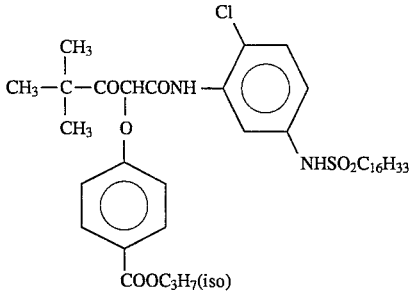

-continued
C-7
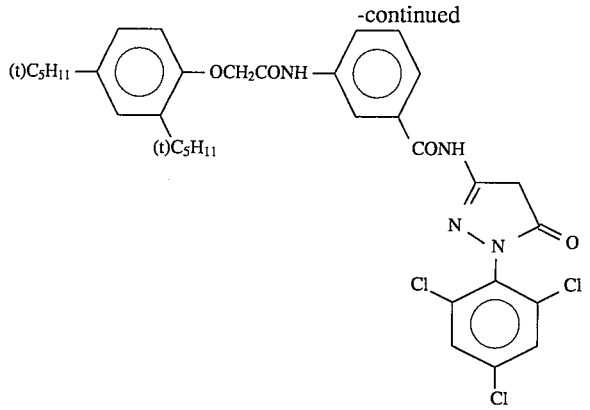
C-11
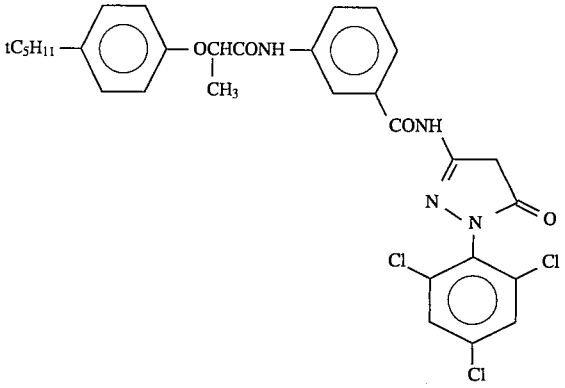
C-8
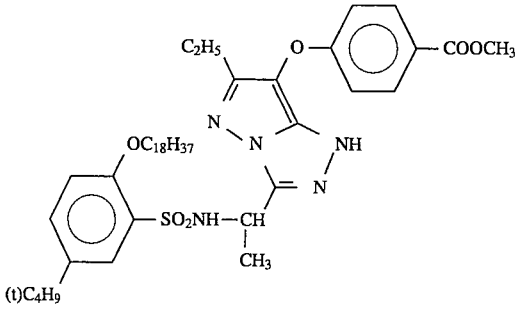
C-9
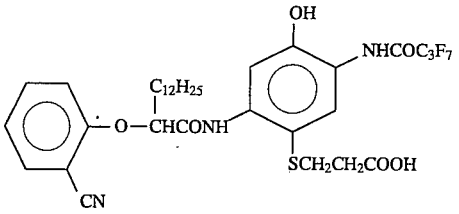
C-10
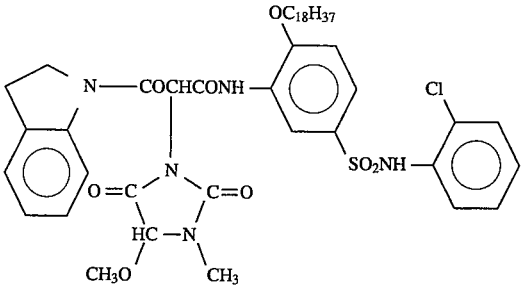
Dibutyl phthalate — Oil-1
Tricresyl phoshate — Oil-2

-continued
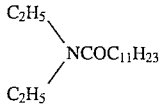
Oil-3
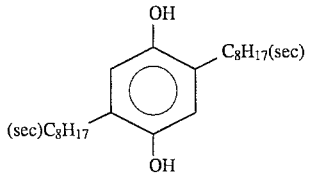
Cpd-A
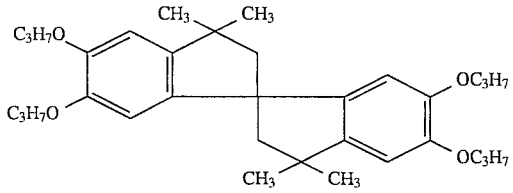
Cpd-B
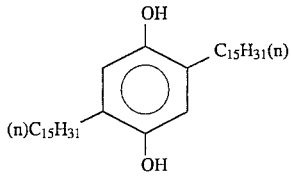
Cpd-C
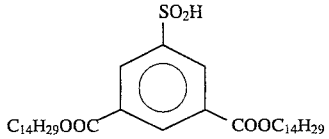
Cpd-D
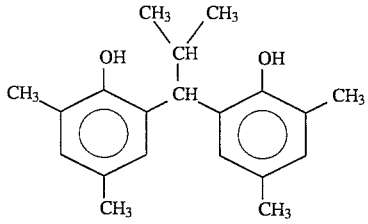
Cpd-E
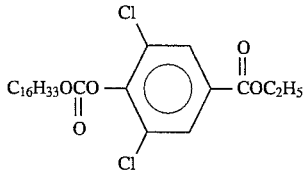
Cpd-F
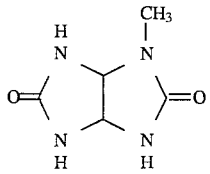
Cpd-H
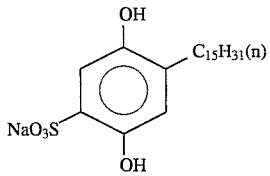
Cpd-I -continued
Cpd-J
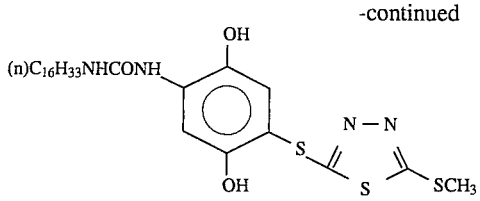
Cpd-K
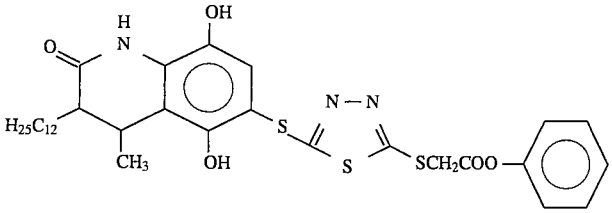
Cpd-L
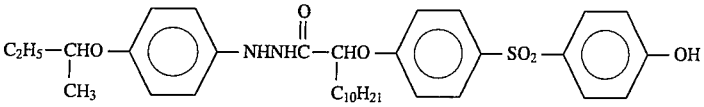
U-1
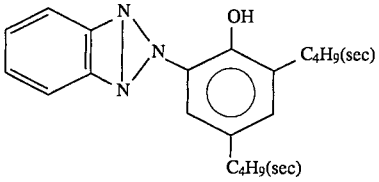
U-2
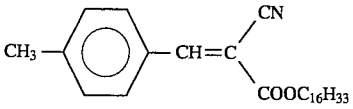
U-3
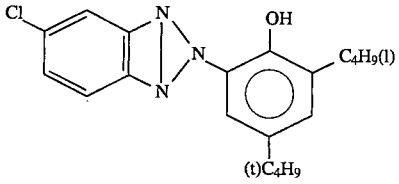
U-4
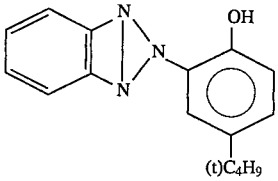
U-5
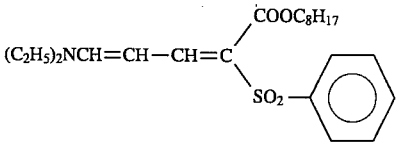
S-1
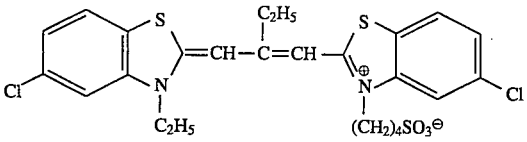
S-2
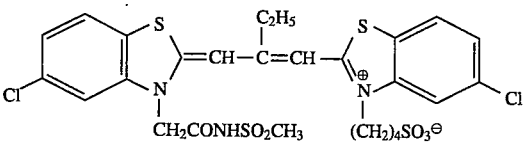

-continued
S-3
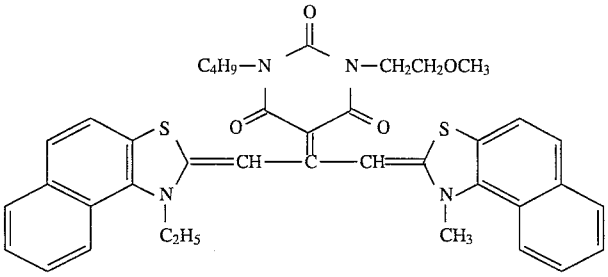
S-4
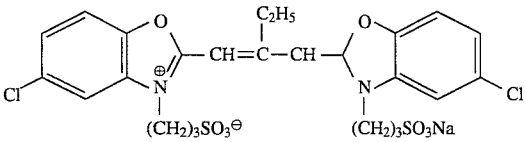
S-8
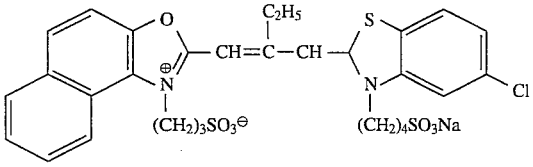
S-5
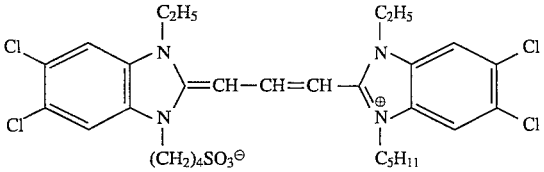
S-6
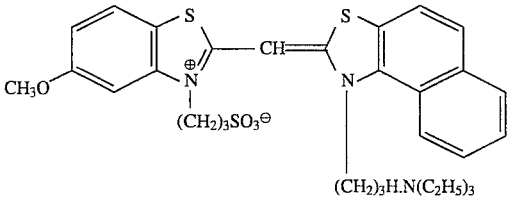
S-7
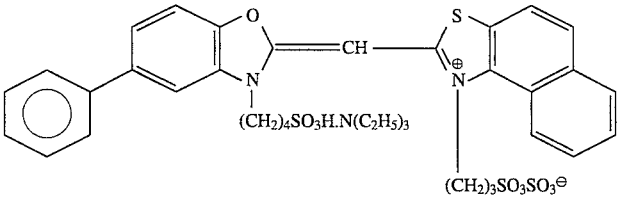
S-9
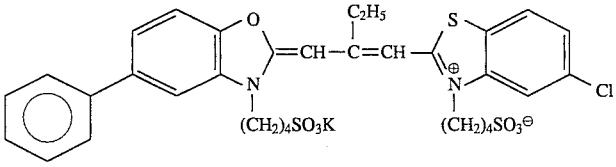
S-10
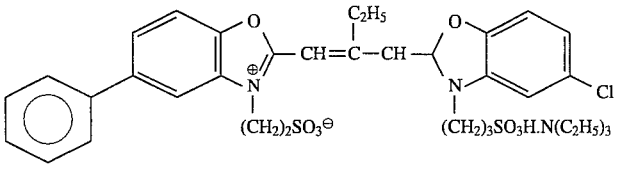

-continued
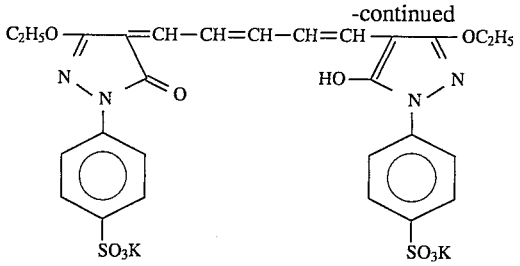
D-1
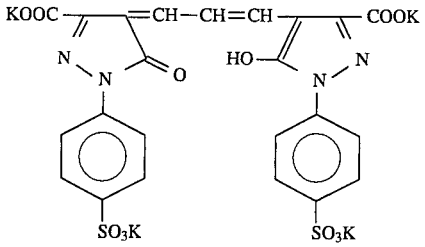
D-2
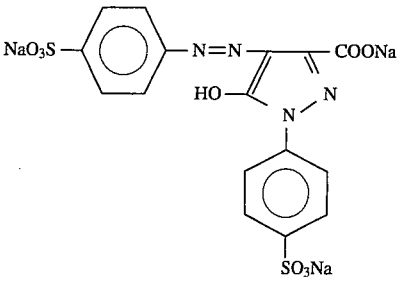
D-3
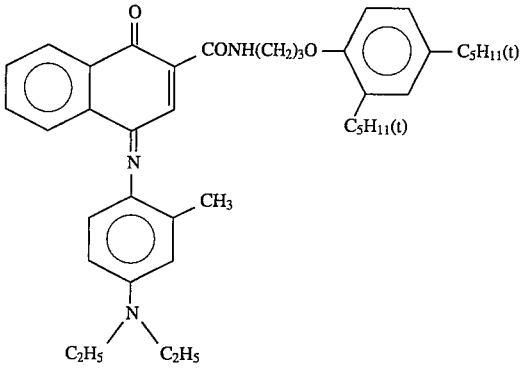
D-4
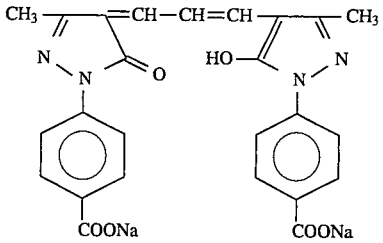
D-5
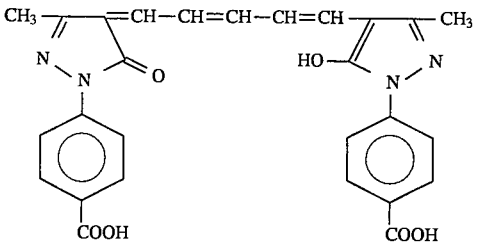
E-1

-continued
E-2
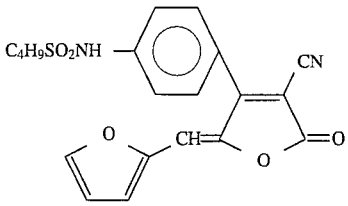
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2\overset{\oplus}{N}(CH_3)_3$
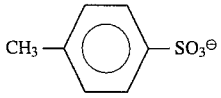
W-2
$C_8F_{17}SO_2N(C_3H_7)CH_2COOK$
W-3
$NaO_3S{-}CH(CH_2COOCH_2CH(C_2H_5)C_4H_9)COOCH_2CH(C_2H_5)C_1H_9$
W-4
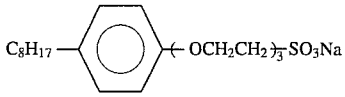
W-5
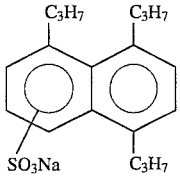
W-6
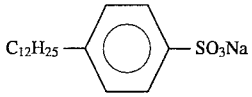
PM-1
$\left(CH_2{-}CH(CONHC_4H_9(t))\right)_n$
M-1
$\left(CH_2{-}CH(COOC_4H_9)\right)_n$
F-1
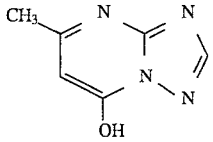
F-2
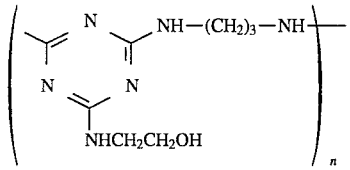
$-HNO_3$
F-3
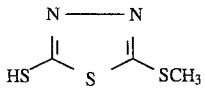

-continued

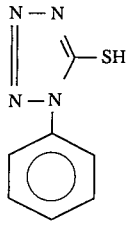

F-4

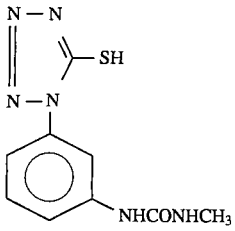

F-5

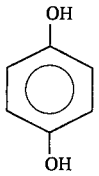

F-6

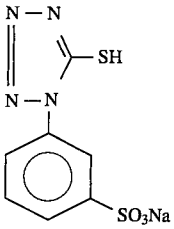

F-7

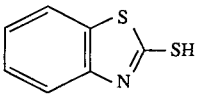

F-8

Preparation of Samples 202 to 206:

Samples 202 to 206 were prepared in the same manner as that in Sample 201, except that Emulsions-2 to 5 and Emulsion a were used in place of Emulsion-1 used for the high blue-sensitive layer of the seventeenth layer in the preparation of Sample 201.

Evaluation of the coated samples:

The sample pieces of the coated Samples 201 to 206, thus obtained, were subjected to a white light wedge exposure for an exposing time of 1/100 second at an exposure of 20 CMS and then to the following development processing, followed by carrying out a sensitometry, whereby obtaining the results shown in Table 7.

Herein, a sensitivity and a latent image preservability were determined by the methods described in Example 1. There was used as an RMS graininess, a value obtained by multiplying a standard deviation in a density fluctuation at a density of 1.0, which was obtained by scanning with a microdensitometer, by 1000.

TABLE 7

| Sample No. | Relative sensitivity in gray exposing | Graininess |
|---|---|---|
| 201 (Inv.) | 105 | 18.8 |
| 202 (Inv.) | 103 | 19.0 |

TABLE 7-continued

| Sample No. | Relative sensitivity in gray exposing | Graininess |
|---|---|---|
| 203 (Inv.) | 104 | 19.2 |
| 204 (Inv.) | 100 | 18.6 |
| 205 (Inv.) | 102 | 19.9 |
| 206 (Comp.) | 100 | 20.3 |

Both of the sensitivity and the graininess were measured as for a yellow image based on a color development in the blue-sensitive layer. The sensitivity was defined by a reciprocal of an exposure giving a minimum density +2.5 and expressed by a value relative to that of Sample 206, which was set as 100.

As shown in Table 7, it is apparent that the monodispersed tabular emulsions in which a grain formation was carried out using the compounds of the present invention have an equal or higher sensitivity and a more excellent graininess than the monodispersed tabular emulsion which was prepared using the comparative compound. Further, also with respect to a latent image preservability, Samples 201 to 205 containing the tabular emulsions which were prepared using the compounds of the present invention showed an excellent preservability as compared with Comparative Sample 206 as was the case with Example 4.

| Processing step | Time | Temperature |
|---|---|---|
| 1st developing | 6 minutes | 38° C. |
| Rinsing | 2 minutes | 38° C. |
| Reversal | 2 minutes | 38° C. |
| Color developing | 6 minutes | 38° C. |
| Pre-bleaching | 2 minutes | 38° C. |
| Bleaching | 6 minutes | 38° C. |
| Fixing | 4 minutes | 38° C. |
| Rinsing | 4 minutes | 38° C. |
| Final rinsing | 1 minute | 25° C. |

The compositions of the respective processing solutions are shown below:

| First developing solution | |
|---|---|
| Pentasodium nitrilo-N,N,N-trimethylenephosphonate | 1.5 g |
| Pentasodium diethylenetriaminepentaacetate | 2.0 g |
| Sodium sulfite | 30 g |
| Hydroquinone · potassium monosulfonate | 20 g |
| Potassium carbonate | 15 g |
| Sodium bicarbonate | 12 g |
| 1-Phenyl-4-methyl-4-hydroxymethyl-3-pyrazolidone | 1.5 g |
| Potassium bromide | 2.5 g |
| Potassium thiocyanate | 1.2 g |
| Potassium iodide | 2.0 mg |
| Diethylene glycol | 13 g |
| Water was added to | 1000 ml |
| pH | 9.60 |
| PH was adjusted with sulfuric acid or potassium hydroxide. | |
| **Reversal solution** | |
| Pentasodium nitrilo-N,N,N-trimethylenephosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Water was added to | 1000 ml |
| pH | 6.00 |
| pH was adjusted with acetic acid or sodium hydroxide | |
| **Color developing solution** | |
| Pentasodium nitrilo-N,N,N-trimethylenephosphonate | 2.0 g |
| Sodium sulfite | 7.0 g |
| Trisodium phosphate 12 hydrate | 36 g |
| Potassium bromide | 1.0 g |
| Potassium iodide | 90 mg |
| Sodium hydroxide | 3.0 g |
| Citrazinic acid | 1.5 g |
| N-ethyl-(β-methanesulfonamidethyl)-3-methyl-4-aminoanline 3/2 sulfate monohydrate | 11 g |
| 3,6-Dithiaoctane-1,8-diol | 1.0 g |
| Water was added to | 1000 ml |
| pH | 11.80 |
| pH was adjusted with sulfuric acid or potassium hydroxide. | |
| **Pre-bleaching solution** | |
| Disodium ethylenediaminetetraacetate dihydrate | 8.0 g |
| Sodium sulfite | 6.0 g |
| 1-Thioglycerol | 0.4 g |
| Formaldehyde/sodium bisulfite adduct | 30 g |
| Water was added to | 1000 ml |
| pH | 6.20 |
| pH was adjusted with acetic acid or sodium hydroxide. | |
| **Bleaching solution** | |
| Disodium ethylenediamineteracetate dihydrate | 2.0 g |
| Fe(III) ammonium ethylenediaminetetraacetate dihydrate | 120 g |

-continued

| | |
|---|---|
| Potassium bromide | 100 g |
| Ammonium nitrate | 10 g |
| Water was added to | 1000 ml |
| pH | 5.70 |
| pH was adjusted with nitric acid or sodium hydroxide. | |
| **Fixing solution** | |
| Ammonium thiosulfate | 80 g |
| Sodium sulfite | 5.0 g |
| Sodium bisulfite | 5.0 g |
| Water was added to | 1000 ml |
| pH | 6.60 |
| pH was adjusted with acetic acid or ammonia water. | |
| **Final rinsing solution** | |
| 1,2-Benzoisothiazoline-3-one | 0.02 g |
| Polyoxyethylene-p-monononylphenyl ether (average polymerization degree: 10) | 0.3 g |
| Polymaleic acid (average molecular weight: 2,000) | 0.1 g |
| Water was added to | 1000 ml |
| pH | 7.0 |

While the invention has been described in detail and with reference-to specific embodiments thereof, it will be apparent to one skilled in the art that various changes and modifications can be made therein without departing from the spirits and scope thereof.

What is claimed is:

1. A silver halide photographic emulsion which is prepared in the presence of:

(A) at least one polymer comprising a recurring unit represented by Formula (1):

$$-(R-O)_n- \quad (1)$$

wherein the polymer having the recurring unit represented by Formula (1) is at least one polymer selected from:

(i) a vinyl polymer having a monomer represented by Formula (3) as a constitutional component:

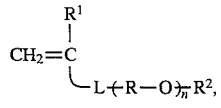

(3)

and (ii) a polyurethane represented by Formula (4):

$$\leftarrow O \leftarrow R-O \rightarrow_n \rightarrow_x \leftarrow O-R^{11}-O \rightarrow_y \leftarrow CONH-R^{12}-NHCO \rightarrow_z; \quad (4)$$

and (B) at least one polymer comprising a recurring unit represented by Formula (2):

$$-(CH_2CH_2O)_m- \quad (2)$$

wherein the polymer having the recurring unit represented by Formula (2) is at least one polymer selected from:

(i) a vinyl polymer having a monomer represented by Formula (5) as a constitutional component:

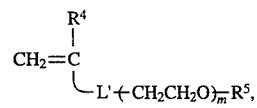

(5)

(ii) a polyurethane represented by Formula (6):

$$\text{—}(O(CH_2CH_2O)_m)_{x'}\text{—}(O\text{—}R^{11}\text{—}O)_{y'}\text{—}(CONH\text{—}R^{12}\text{—}NHCO)_{z'}\text{—}, \quad (6)$$

and (iii) polyethylene glycol which may be substituted by an alkyl group or an aryl group having from 1 to 30 carbon atoms;

wherein R represents an alkylene group having 3 to 10 carbon atoms; n represents an average number of the recurring unit of from 4 to 200; m represents an average number of the recurring unit of from 6 to 50;

$R^1$ and $R^4$ each represents a hydrogen atom or a lower alkyl group having 1 to 4 carbon atoms; $R^2$ and $R^5$ each represents a hydrogen atom or a monovalent substituent having 1 to 20 carbon atoms; L and L' each represents a divalent linkage group; $R^{11}$ and $R^{12}$ each represents an alkylene group having 1 to 20 carbon atoms, a phenylene group having 6 to 20 carbon atoms or an aralkylene group having 7 to 20 carbon atoms; x, y, z, x', y' and z' each represents weight percentages of the recurring components; x and x' each represents 1 to 70; y and y' each represents 1 to 70; and z and z' each represents 20 to 70, wherein x+y+z=100 and x'+y'+z'=100.

2. The silver halide photographic emulsion as claimed in claim 1, wherein R in the formula (I) represents —$CH_2CH(CH_3)$— or —$CH(CH_3)CH_2$—.

3. The silver halide photographic emulsion as claimed in claim 1, wherein the emulsion contains tabular grains having an aspect ratio of 2 to 100.

4. The silver halide photographic emulsion as claimed in claim 3, wherein the tabular grains have a fluctuation coefficient of 20% or less in a circle-corresponding diameter.

5. The silver halide photographic emulsion as claimed in claim 4, wherein the tabular grains have a fluctuation coefficient of 15% or less in a circle-corresponding diameter.

6. A silver halide photographic material comprising a support and provided thereon at least one light-sensitive silver halide emulsion layer, wherein the silver halide emulsion layer contains the silver halide emulsion described in claim 1.

* * * * *